US009577325B2

(12) United States Patent
Andujar Linares et al.

(10) Patent No.: US 9,577,325 B2
(45) Date of Patent: Feb. 21, 2017

(54) COMPACT RADIATING ARRAY FOR WIRELESS HANDHELD OR PORTABLE DEVICES

(71) Applicant: Fractus, S.A., Barcelona (ES)

(72) Inventors: Aurora Andujar Linares, Barcelona (ES); Jaume Anguera Pros, Vinaros (ES); Cristina Picher Planellas, Barcelona (ES)

(73) Assignee: Fractus Antennas, S.L., Barcelona (ES)

( * ) Notice: Subject to any disclaimer, the term of this patent is extended or adjusted under 35 U.S.C. 154(b) by 137 days.

(21) Appl. No.: 13/799,857

(22) Filed: Mar. 13, 2013

(65) Prior Publication Data

US 2013/0342416 A1 Dec. 26, 2013

Related U.S. Application Data

(60) Provisional application No. 61/661,885, filed on Jun. 20, 2012.

(51) Int. Cl.
*H01Q 1/50* (2006.01)
*H01Q 1/24* (2006.01)
(Continued)

(52) U.S. Cl.
CPC ..... *H01Q 1/50* (2013.01); *H01Q 1/243* (2013.01); *H01Q 9/42* (2013.01); *H01Q 21/28* (2013.01)

(58) Field of Classification Search
CPC ..... H01Q 1/50
(Continued)

(56) References Cited

U.S. PATENT DOCUMENTS 6,388,631 B1 5/2002 Livingston et al.
6,762,723 B2 7/2004 Nallo et al.
(Continued)

FOREIGN PATENT DOCUMENTS

JP 2005175846 6/2005
WO 2007/141187 12/2007
(Continued)

OTHER PUBLICATIONS

Chan , S. P., The electrical engineering handbook , Boca Raton CRC Press, dated Jan. 14, 2000.
(Continued)

*Primary Examiner* — Dameon E Levi
*Assistant Examiner* — Walter Davis
(74) *Attorney, Agent, or Firm* — Edell, Shapiro & Finnan LLC

(57) ABSTRACT

A radiating system transmits and receives in first and second frequency regions and includes a radiating structure comprising first and second radiation boosters having maximum sizes smaller than 1/30 times the free-space wavelength of the lowest frequencies of the first and second frequency regions, respectively. The radiating system further includes a radiofrequency system having first and second ports respectively connected to first and second internal ports of the radiating structure, and a third port connected to an external port of the radiating system. The radiofrequency system includes: first and second reactance cancellation element providing impedances having an imaginary part close to zero for respective frequencies in the first and second frequency regions and a delay element interconnecting the first and second reactance cancellation elements to provide a difference in phase therebetween to produce first and second impedance loops in the first and second frequency region, respectively, at the external port.

19 Claims, 22 Drawing Sheets

(51) Int. Cl.
*H01Q 9/42* (2006.01)
*H01Q 21/28* (2006.01)

(58) Field of Classification Search
USPC ..... 343/843, 702, 853; 455/575.7
See application file for complete search history.

(56) References Cited

U.S. PATENT DOCUMENTS

| | | | | |
|---|---|---|---|---|
| 6,873,299 | B2 | 3/2005 | Dakeya et al. | |
| 7,170,463 | B1 | 1/2007 | Seavey | |
| 7,274,340 | B2 | 9/2007 | Ozden | |
| 7,292,195 | B2 * | 11/2007 | Phillips | H01Q 9/42 343/744 |
| 7,760,146 | B2 | 7/2010 | Ollikainen | |
| 8,178,457 | B2 | 5/2012 | De Rochemont | |
| 8,738,103 | B2 * | 5/2014 | Puente Baliarda | H01Q 1/243 455/575.7 |
| 9,112,284 | B2 | 8/2015 | Andujar Linares et al. | |
| 2003/0063036 | A1 | 4/2003 | Sato et al. | |
| 2006/0214856 | A1 | 9/2006 | Nakano et al. | |
| 2010/0109955 | A1 * | 5/2010 | Anguera | H01Q 1/243 343/702 |
| 2010/0176999 | A1 * | 7/2010 | Anguera | H01Q 1/243 343/702 |
| 2011/0117976 | A1 | 5/2011 | Nishikido et al. | |
| 2012/0288762 | A1 | 11/2012 | Hardin | |
| 2013/0004658 | A1 | 1/2013 | Yang | |

FOREIGN PATENT DOCUMENTS

| | | | |
|---|---|---|---|
| WO | 2008119699 | A1 | 10/2008 |
| WO | 2010/015364 | | 2/2010 |
| WO | 2010/015365 | | 2/2010 |
| WO | 2011/095330 | | 8/2011 |
| WO | 2012/017013 | | 2/2012 |
| WO | 2012/100178 | | 7/2012 |

OTHER PUBLICATIONS

Wong, Kin-Lu, Planar antennas for wireless communications, Wiley Interscience , dated: Jan. 1, 2003.

Villanen, J., Miniaturization and evaluation methods of mobile terminal antenna structures, Helsinki University of Technology. Radio Laboratory Publications, dated: Sep. 3, 2007.

* cited by examiner

COMPACT RADIATING ARRAY FOR WIRELESS HANDHELD OR PORTABLE DEVICES

CROSS REFERENCE TO RELATED APPLICATIONS

This application claims priority under 35 U.S.C. §119(e) from U.S. Provisional Patent Application Ser. No. 61/661,885, filed Jun. 20, 2012, and entitled "Compact Radiating Array for Wireless Handheld or Portable Devices," the entire contents of which are hereby incorporated by reference.

FIELD OF THE INVENTION

The present invention relates to the field of wireless handheld devices, and generally to wireless portable devices which require the transmission and reception of electromagnetic wave signals.

BACKGROUND

Wireless handheld or portable devices typically operate one or more cellular communication standards, and/or wireless connectivity standards, and/or broadcast standards, each standard being allocated in one or more frequency bands, and said frequency bands being contained within one or more regions of the electromagnetic spectrum.

For that purpose, a space within the wireless handheld or portable device is usually dedicated to the integration of a radiating system. The radiating system is, however, expected to be small in order to occupy as little space as possible within the device, which then allows for smaller devices, or for the addition of more specific equipment and functionality into the device. At the same time, it is sometimes required for the radiating system to be flat since this allows for slim devices or in particular, for devices which have two parts that can be shifted or twisted against each other.

Many of the demands for wireless handheld or portable devices also translate to specific demands for the radiating systems thereof.

A typical wireless handheld or portable device must include a radiating system capable of operating in one or more frequency bands of the electromagnetic spectrum with good radioelectric performance (such as for example in terms of input impedance level, impedance bandwidth, gain, efficiency, or radiation pattern). Moreover, the integration of the radiating system within the wireless handheld or portable device must be correct to ensure that the wireless handheld or portable device itself attains a good radioelectric performance (such as for example in terms of radiated power, received power, sensitivity, or SAR).

This is even more critical in the case in which the wireless handheld device is a multifunctional wireless device. Commonly-owned patent applications WO2008/009391 and US2008/0018543 describe a multifunctional wireless device. The entire disclosure of said application numbers WO2008/009391 and US2008/0018543 are hereby incorporated by reference.

For a good wireless connection, high gain and efficiency are further required. Other more common design demands for radiating systems are the voltage standing wave ratio (VSWR) and the impedance which is supposed to be about 50 ohms.

Other demands for radiating systems for wireless handheld or portable devices are low cost and a low specific absorption rate (SAR).

Furthermore, a radiating system has to be integrated into a device or in other words a wireless handheld or portable device has to be constructed such that an appropriate radiating system may be integrated therein which puts additional constraints by consideration of the mechanical fit, the electrical fit and the assembly fit.

Of further importance, usually, is the robustness of the radiating system which means that the radiating system does not change its properties upon smaller shocks to the device.

A radiating system for a wireless handheld or portable device typically includes a radiating structure comprising an antenna element which operates in combination with a ground plane layer providing a determined radioelectric performance in one or more frequency regions of the electromagnetic spectrum. This is illustrated in FIG. 23, in which it is shown a conventional radiating structure 2300 comprising an antenna element 2301 and a ground plane layer 2302. Typically, the antenna element has a dimension close to an integer multiple of a quarter of the wavelength at a frequency of operation of the radiating structure, so that the antenna element is at resonance or substantially close to resonance at said frequency and a radiation mode is excited on said antenna element. It is important to stress that the relationship between the operating wavelength and the size of the antenna is due to a well-known principle that an antenna needs to keep a minimum proportion with respect to such operating wavelength to radiate efficiently. Therefore, it is the conventional wisdom that an antenna which is much smaller than the wavelength would radiate quite inefficiently, and in the limit, would not radiate at all. The fundamental limitations of small antennas where first established by Chu and Wheeler in the 1940's; who described that a small antenna inherently suffered of a reduced bandwidth and eventually a decreased radiation efficiency.

In some cases, the antenna element acting in cooperation with the ground plane does not attain sufficient impedance bandwidth as for covering multiple communication standards and a matching network must be added between the antenna element and the input/output port in order to increase said impedance bandwidth. Some inconveniences of adding matching networks in multiband radiating systems mainly rely on the fact that usually the proper values to match a particular frequency band not necessary coincide with those required to match another frequency band. This inconvenience further exacerbates when the frequency bands to match are allocated at separate frequency regions of the electromagnetic spectrum.

In addition, antenna elements operating in multiple frequency bands allocated at different regions of the electromagnetic spectrum usually presents a complex geometry and considerable dimensions, mainly due to the fact that antenna performance is highly related to the electrical dimensions of the antenna element.

A further problem associated to the integration of the radiating structure, and in particular to the integration of the antenna element, in a wireless device is that the volume dedicated for such an integration has continuously shrunk with the appearance of new smaller and/or thinner form factors for wireless devices, and with the increasing convergence of different functionality in a same wireless device.

Some techniques to miniaturize and/or optimize the multiband behavior of an antenna element have been described in the prior art. However the radiating structures described therein still rely on exciting a radiation mode on the antenna element for each one of the frequency bands of operation. This fact leads to complex antenna elements that usually are very sensitive to external effects (such as for instance the presence of plastic or dielectric covers that surround the wireless device), to components of the wireless device (such as for instance, but not limited to, a speaker, a microphone, a connector, a display, a shield can, a vibrating module, a battery, or an electronic module or subsystem) placed either in the vicinity of, or even underneath, the radiating element, and/or to the presence of the user of the wireless device. A multiband antenna system is sensitive to any of the above mentioned aspects because they may alter the electromagnetic coupling between the different geometrical portions of the radiating element, which usually translates into detuning effects, degradation of the radioelectric performance of the antenna system and/or the radioelectric performance wireless device, and/or greater interaction with the user (such as an increased level of SAR).

For example, commonly-owned co-pending patent application US2007/0152886 describes a new family of antennas based on the geometry of space-filling curves. Also, commonly-owned co-pending patent application US2008/0042909 relates to a new family of antennas, referred to as multilevel antennas, formed by an electromagnetic grouping of similar geometrical elements. The entire disclosures of the aforesaid application numbers US2007/0152886 and US2008/0042909 are hereby incorporated by reference.

In this sense, a radiating system not requiring a complex antenna formed by multiple arms, slots, apertures and/or openings such as the one described in the present invention is preferable in some embodiments in order to minimize such undesired external effects.

Some other attempts have focused on antenna elements not requiring a complex geometry while still providing some degree of miniaturization by using an antenna element that is not resonant in the one or more frequency ranges of operation of the wireless device.

For example, WO2007/128340 discloses a wireless portable device comprising a non-resonant antenna element for receiving broadcast signals (such as, for instance, DVB-H, DMB, T-DMB or FM). The wireless portable device further comprises a ground plane layer that is used in combination with said antenna element. Although the antenna element has a first resonant frequency above the frequency range of operation of the wireless device, the antenna element is still the main responsible for the radiation process and for the electromagnetic performance of the wireless device. This is clear from the fact that no radiation mode can be excited on the ground plane layer because the ground plane layer is electrically short at the frequencies of operation (i.e., its dimensions are much smaller than the wavelength). For this kind of non-resonant antenna elements, a matching circuitry is added for matching the antenna to acceptable level of VSWR which in this particular case can be around VSWR≤6, which is only acceptable for reception of electromagnetic wave signals but not enough for allowing their transmission.

With such limitations, while the performance of the wireless portable device may be sufficient for reception of electromagnetic wave signals (such as those of a broadcast service), the antenna element could not provide an adequate performance (for example, in terms of input return losses or gain) for a communication standard requiring also the transmission of electromagnetic wave signals.

Commonly-owned patent application WO2008/119699 describes a wireless handheld or portable device comprising a radiating system capable of operating in two frequency regions. The radiating system comprises an antenna element having a resonant frequency outside said two frequency regions, and a ground plane layer. In this wireless device, while the ground plane layer contributes to enhance the electromagnetic performance of the radiating system in the two frequency regions of operation, it is still necessary to excite a radiation mode on the antenna element. In fact, the radiating system relies on the relationship between a resonant frequency of the antenna element and a resonant frequency of the ground plane layer in order for the radiating system to operate properly in said two frequency regions.

Nevertheless, the solution still relies on a complex matching network including resonators and filters for each frequency region of operation.

The entire disclosure of the aforesaid application number WO2008/119699 is hereby incorporated by reference.

Other attempts for covering several frequency bands allocated in a particular frequency region of the electromagnetic spectrum rely on the use of antenna elements distributed along the ground plane of a wireless handheld or portable device as disclosed in a commonly-owned patent application WO2007/141187. Each one of the antenna elements of said distributed antenna system resonates or substantially resonates at a frequency within a first frequency region of the electromagnetic spectrum, thus providing redundancy to the radiating system. Said redundancy allows increasing the robustness to human loading effects.

Another limitation of current wireless handheld or portable devices relates to the fact that the design and integration of an antenna element for a radiating structure in a wireless device is typically customized for each device. Different form factors or platforms, or a different distribution of the functional blocks of the device will force to redesign the antenna element and its integration inside the device almost from scratch.

For at least the above reasons, wireless device manufacturers regard the volume dedicated to the integration of the radiating structure, and in particular the antenna element, as being a toll to pay in order to provide wireless capabilities to the handheld or portable device.

In order to reduce as much as possible the volume occupied into the wireless handheld or portable device, recent trends in handset antenna design are oriented to maximize the contribution of the ground plane to the radiation process by using non-resonant elements. However, non-resonant elements usually are forced to include a complex radiofrequency system. Thus, the challenge of these techniques mainly relies on said complexity (combination of inductors, capacitors, and transmission lines), which is required to satisfy impedance bandwidth and efficiency specifications.

Commonly owned patent applications, WO2010015365 and WO2010/015364 are intended for solving some of the aforementioned drawbacks. Namely, they describe a wireless handheld or portable device comprising a radiating system including a radiating structure and a radiofrequency system. The radiating structure is formed by a ground plane layer presenting suitable dimensions as for supporting at least one efficient radiation mode and at least one radiation booster capable of coupling electromagnetic energy to said ground plane layer. The radiation booster is not resonant in any of the frequency regions of operation and consequently a radiofrequency system is used to properly match the radiating structure to the desired frequency bands of operation.

More particularly, in WO2010/015364 each radiation booster is intended for providing operation in a particular frequency region. Thus, the radiofrequency system is designed in such a way that the first internal port associated to the first radiation booster is highly isolated from the second internal port associated to a second radiation booster. Said radiofrequency system usually comprises a matching network including resonators for each one of the frequency regions of operation and a set of filters for each one of the frequency regions of operation. Thus, said radiofrequency system requires multiple stages and the performance of the radiating systems in terms of efficiency may be affected by the additional losses of the components.

A radiation booster should not be confused with a radiating element. Being much smaller than the operating wavelength of the system, the radiation booster alone would be incapable to transmit or receive electromagnetic signals within such operating wavelength. Therefore, a radiation booster can not be considered on its own an antenna or a radiating element.

Another technique, as disclosed in U.S. Pat. No. 7,274,340, is based on the use of non-resonant elements where the impedance matching is provided through the addition of two matching circuits. The two non-resonant elements are arranged in such a manner that they provide coupling to the ground plane. Despite the use of two non-resonant elements, the size of the element for the low band is significantly large, being 1/9.3 times the free-space wavelength of the lowest frequency for the low frequency band. Due to such size, the low band element would be a resonant element at the high band. The size of the low band element undesirably contributes to increase the printed circuit board (PCB) space required by the antenna module. In fact, such radiating system is still about the size of a conventional internal antenna inside a handset, therefore the overall radiating system does not provide a significant space advantage compared to the existing alternative solutions.

Therefore, a wireless device including small antenna elements or even not requiring an antenna element together with a simplified radiofrequency system would be advantageous to make simpler the integration of the radiating structure into the wireless handheld or portable device. The volume freed up by the absence of a large and complex antenna element would enable smaller and/or thinner devices, or even to adopt radically new form factors (such as for instance elastic, stretchable and/or foldable devices) which are not feasible today due to the presence of an antenna element featured by a considerable volume. Furthermore, by eliminating precisely the element that requires customization, a standard solution is obtained which only requires minor adjustments to be implemented in different wireless devices.

SUMMARY

In order to solve aforementioned drawbacks, the present invention provides a wireless handheld or portable device including an array of radiation boosters and/or radiating elements and a simplified radiofrequency system comprising a delay element. With the present invention, the adequate radioelectric performance in two or more frequency regions of the electromagnetic spectrum is achieved by establishing a difference in phase between at least two radiation boosters, or between at least one radiation booster and at least one radiating element or even between at least two radiating elements, which are combined into a single input/output port. Said difference in phase provides operation in at least two frequency regions of the electromagnetic spectrum while simplifies the number of reactive elements required. In this sense, a radiofrequency system according to the present invention is characterized in its simplicity which means the use of a reduced number of reactive components. This simplicity reduces the losses, becomes more robust to tolerances, and it is easier to integrate in a wireless handheld or portable device platform. Furthermore, the use of radiation boosters provides the highest level of miniaturization whereas the use of radiating elements further reduces complexity of the radiofrequency system.

It is an object of the present invention to provide a wireless handheld or portable device (such as for instance but not limited to a mobile phone, a smartphone, a PDA, an MP3 player, a headset, a USB dongle, a laptop computer, a tablet, a phablet, a gaming device, a GPS system, a digital camera, a PCMCIA or Cardbus 32 card, or generally a multifunction wireless device) which attains the transmission and reception of electromagnetic wave signals through the proper combination into an input/output port of the frequency responses of several radiation boosters and/or radiating elements strategically arranged along the ground plane of a wireless handheld or portable device. Said radiation boosters and radiating elements are integrated within said wireless handheld or portable device. Such wireless device is yet capable of operation in two or more frequency regions of the electromagnetic spectrum with enhanced radioelectric performance, increased robustness to external effects and neighboring components of the wireless device, and/or reduced interaction with the user.

Another object of the invention relates to a method to enable the operation of a wireless handheld or portable device in two or more frequency regions of the electromagnetic spectrum with enhanced radioelectric performance, increased robustness to external effects and neighboring components of the wireless device, and/or reduced interaction with the user.

Radiating structures comprising radiation boosters and/or simple radiating elements strategically arranged along a ground plane capable of supporting an efficient radiation mode become preferable for reducing the required space within the wireless handheld or portable device. This fact allows and simplifies the integration of other components and functionalities inside the wireless handheld or portable device. Nevertheless, said radiating structures usually are forced to use radiofrequency systems comprising a large number of reactive elements to allow the operation of the radiating system in multiple frequency bands.

In this sense, a further object of the present invention is focused on providing a simplified radiofrequency system, which in combination with a radiating structure comprising radiation boosters and/or radiating elements provides operation in at least two frequency regions of the electromagnetic spectrum with a reduced number of reactive elements. The radiofrequency system provides a difference in phase between the input impedances of two or more ports of the radiating structure. Said difference in phase provides operation in at least two frequency bands, each one allocated in a different frequency region of the electromagnetic spectrum, and/or increases the number of operating frequency bands in at least one frequency region of the electromagnetic spectrum, and/or increases the number of operating frequency bands in at least two frequency regions of the electromagnetic spectrum.

A wireless handheld or portable device according to the present invention operates two, three, four or more communication standards, namely two, three, four or more cellular communication standards (such as for example LTE700, GSM 850, GSM 900, GSM 1800, GSM 1900, UMTS, HSDPA, CDMA, W-CDMA, LTE2100, LTE2300, LTE2500, CDMA2000, TD-SCDMA, etc.), wireless connectivity standards (such as for instance WiFi, IEEE802.11 standards, Bluetooth, ZigBee, UWB, WiMAX, WiBro, or other high-speed standards), and/or broadcast standards (such as for instance FM, DAB, XDARS, SDARS, DVB-H, DMB, T-DMB, or other related digital or analog video and/or audio standards), each standard being allocated in one or more frequency bands, and said frequency bands being contained within two, three or more frequency regions of the electromagnetic spectrum.

In the context of this document, a frequency band preferably refers to a range of frequencies used by a particular cellular communication standard, a wireless connectivity standard or a broadcast standard; while a frequency region preferably refers to a continuum of frequencies of the electromagnetic spectrum. For example, the GSM 1800 standard is allocated in a frequency band from 1710 MHz to 1880 MHz while the GSM 1900 standard is allocated in a frequency band from 1850 MHz to 1990 MHz. A wireless device operating the GSM 1800 and the GSM 1900 standards must have a radiating system capable of operating in a frequency region from 1710 MHz to 1990 MHz. As another example, a wireless device operating the GSM 1800 standard and a UMTS standard (allocated in a frequency band from 1920 MHz to 2170 MHz), must have a radiating system capable of operating in two separate frequency regions.

A wireless handheld or portable device according to the present invention comprises a radiating system that operates in at least two communication standards, each one allocated in a different frequency region of the electromagnetic spectrum.

The wireless handheld or portable device according to the present invention may have a candy-bar shape, which means that its configuration is given by a single body. It may also have a two-body configuration such as a clamshell, flip-type, swivel-type or slider structure. In some other cases, the device may have a configuration comprising three or more bodies. It may further or additionally have a twist configuration in which a body portion (e.g. with a screen) can be twisted (i.e., rotated around two or more axes of rotation which are preferably not parallel). Also, the present invention makes it possible for radically new form factors, such as for example devices made of elastic, stretchable and/or foldable materials.

For a wireless handheld or portable device which is slim and/or whose configuration comprises two or more bodies, the requirements on maximum height of the antenna element are very stringent, as the maximum thickness of each of the two or more bodies of the device may be limited to 5, 6, 7, 8, 9, 10, 11, 12, or 15 mm. The technology disclosed herein makes it possible for a wireless handheld or portable device to feature an enhanced radioelectric performance by properly exciting an effective ground plane radiation mode without requiring an antenna featured by a complex geometry, nor a complex radiofrequency system.

In accordance with the present invention, the wireless handheld or portable device includes a radiating system capable of transmitting and receiving electromagnetic wave signals in at least two communication standards, each one allocated in a different frequency region of the electromagnetic spectrum: a first frequency region and a second frequency region, wherein preferably the highest frequency of the first frequency region is lower than the lowest frequency of the second frequency region. Said radiating system comprises a radiating structure comprising: at least one ground plane layer capable of supporting at least one radiation mode, the at least one ground plane layer including at least one connection point; at least two radiation boosters to couple electromagnetic energy from/to the at least one ground plane layer. A first radiation booster including a first connection point and a second radiation booster including a second connection point; and at least two internal ports. A first internal port is defined between the connection point of the first radiation booster and one of the at least one connection points of the at least one ground plane layer. The second internal port is defined between the connection point of the second radiation booster and one of the at least one connection points of the at least one ground plane layer. The radiating system further comprises a radiofrequency system that provides a difference in phase between a first input impedance and a second input impedance. The radiofrequency system further comprises a port connected to an external port of the radiating system, namely to an input/output port.

In the context of this document, a radiation booster is defined as an element that presents a first resonant frequency placed substantially above the first and the second frequency region of operation. Said first resonant frequency is measured at the internal port of the radiating structure when the radiofrequency system is disconnected. Said internal port is defined between a connection point of the radiation booster and a connection point of the ground plane layer.

In the context of this document, a resonant frequency associated to an internal port of a radiating structure preferably refers to a frequency at which the input impedance measured at said internal port of the radiating structure, when disconnected from the radiofrequency system, has an imaginary part substantially equal to zero.

In some examples, the first resonant frequency at an internal port of the radiating structure is located above a third frequency region of operation of the radiating system, said third frequency region having a lowest frequency higher than the highest frequency of the second frequency region of operation of said radiating system.

In some further examples, for at least some of, or even all, the internal ports of the radiating structure, the ratio between the first resonant frequency at a given internal port of the radiating structure when disconnected from the radiofrequency system and the highest frequency of said first frequency region is preferably larger than a certain minimum ratio. Some possible minimum ratios are 3.0, 3.4, 3.8, 4.0, 4.2, 4.4, 4.6, 4.8, 5.0, 5.2, 5.4, 5.6, 5.8, 6.0, 6.2, 6.6 or 7.0.

With the/each radiation booster being so small, and with the radiating structure including said radiation booster or boosters operating in a frequency range much lower than the first resonant frequency at the/each internal port associated to the/each radiation booster, the input impedance of the radiating structure (measured at the/each internal port when the radiofrequency system is disconnected) features an important reactive component (either capacitive or inductive) within the range of frequencies of the first and/or second frequency region of operation. That is, the input impedance of the radiating structure at the/each internal port when disconnected from the radiofrequency system has an imaginary part not equal to zero for any frequency of the first and/or second frequency region.

In accordance with a second aspect of the present invention, the wireless handheld or portable device includes a radiating system capable of transmitting and receiving electromagnetic wave signals in at least two communication standards, each one allocated in a different frequency region of the electromagnetic spectrum: a first frequency region and a second frequency region, wherein preferably the highest frequency of the first frequency region is lower than the lowest frequency of the second frequency region. Said radiating system comprises a radiating structure comprising: at least one ground plane layer capable of supporting at least one radiation mode, the at least one ground plane layer including at least one connection point; and at least two radiating elements. A first radiating element including a first connection point and a second radiating element including a second connection point; and at least two internal ports. A first internal port is defined between the connection point of the first radiating element and one of the at least one connection points of the at least one ground plane layer. The second internal port is defined between the connection point of the second radiating element and one of the at least one connection points of the at least one ground plane layer. The radiating system further comprises a radiofrequency system that provides a difference in phase between first input impedance and second input impedance. The first and the second input impedances are measured, respectively, at the first and second internal ports. The radiofrequency system further comprises a port connected to an external port of the radiating system, namely to an input/output port.

In the context of this document, the term radiating element is used to define an element that presents a first resonant frequency allocated in at least one of the first and the second frequency regions of the electromagnetic spectrum. Said first resonant frequency is measured at the internal port of the radiating structure defined between a connection point of the radiating element and a connection point of the ground plane layer when disconnected from the radiofrequency system. In some particular cases, the radiating element features an input impedance measured at its internal port substantially close to 50Ω for the frequencies of at least one of the first and the second frequency region of operation.

In the context of this document, an input impedance substantially close to 50Ω mainly refers to an input impedance inscribed in a circle of VSWR≤3.

In some cases the radiating system combines at least one radiation booster with at least one radiating element into a single input/output port. In this case, the radiation booster includes a connection point, which together with a connection point of the ground plane layer defines a first internal port. A second internal port is defined between a connection point of the radiating element and a connection point of the ground plane layer. Both, first and second internal ports are connected to a radiofrequency system which also comprises a port connected to an external port of the radiating system, namely to an input/output port. Said radiofrequency system is capable of providing a difference in phase between first input impedance and second input impedance, which allows the operation of the radiating system in at least two frequency regions of the electromagnetic spectrum.

The radiofrequency system comprises at least two ports, each one connected to one internal port of the radiating structure (i.e. the radiating structure comprises at least two internal ports), and a port connected to the external port of the radiating system. Said radiofrequency system produces a phase difference and provides impedance matching to the radiating system in the at least two frequency regions of operation of the radiating system. Namely, the radiofrequency system allows the operation of the radiating system in at least two communication standards, each one allocated in at least two separate frequency regions of the electromagnetic spectrum.

In the context of this document operation in at least two frequency regions means that the radiating system operates at least one frequency band allocated in each one of the frequency regions of operation.

In some cases, the radiating structure is capable of providing operation in at least one frequency band allocated in at least one frequency region of the electromagnetic spectrum. In these cases, a radiofrequency system according to the present invention increases the number of operating frequency bands in at least two frequency regions of the electromagnetic spectrum.

In this sense and in accordance with an advantageous aspect of the present invention, the proposed radiofrequency system provides operation in at least two frequency bands, each one allocated in a different frequency region of the electromagnetic spectrum, and/or increases the number of operating frequency bands in at least one frequency region of the electromagnetic spectrum, and/or increases the number of operating frequency bands in at least two frequency regions of the electromagnetic spectrum.

In this text, a port of the radiating structure is referred to as an internal port; while a port of the radiating system is referred to as an external port. In this context, the terms "internal" and "external" when referring to a port are used simply to distinguish a port of the radiating structure from a port of the radiating system, and carry no implication as to whether a port is accessible from the outside or not.

In some examples, the radiating system is capable of operating in at least two, three, four, five or more frequency regions of the electromagnetic spectrum, said frequency regions allowing the allocation of two, three, four, five, six or more frequency bands used in one or more standards of cellular communications, wireless connectivity and/or broadcast services.

In some examples, a frequency region of operation (such as for example the first and/or the second frequency region) of a radiating system is preferably one of the following (or contained within one of the following): 80-120 MHz, 180-220 MHz, 470-800 MHz, 690-960 MHz, 1710-2690 MHz, 2.4-2.5 GHz, 3.4-3.6 GHz, 4.9-5.875 GHz, or 3.1-10.6 GHz.

In some embodiments, the radiating structure comprises two, three, four or more radiation boosters, each of said radiation boosters including a connection point, and each of said connection points defining, together with a connection point of the at least one ground plane layer, an internal port of the radiating structure. Therefore, in some embodiments the radiating structure comprises two, three, four or more radiation boosters, and correspondingly two, three, four or more internal ports.

In some embodiments, the radiating structure comprises two, three, four or more radiating elements, each of said radiating elements including a connection point, and each of said connection points defining, together with a connection point of the at least one ground plane layer, an internal port of the radiating structure. Therefore, in some embodiments the radiating structure comprises two, three, four or more radiating elements, and correspondingly two, three, four or more internal ports.

In some embodiments, the radiating structure comprises at least one radiation booster and at least one radiating element, each of said radiation booster and radiating element include a connection point, and each of said connection points define, together with a connection point of the at least one ground plane layer, an internal port of the radiating structure.

In some examples, a same connection point of the at least one ground plane layer is used to define at least two, three, or even all, internal ports of the radiating structure.

The radiofrequency system comprises a delay element to provide a difference in phase between the input impedances associated to the at least two internal ports of the radiating structure. Said phase difference is selected to minimize the reflection coefficient measured at the external port of the radiating system in at least two frequency regions of the electromagnetic spectrum when both input impedances are combined into a single input/output port.

In this text, the expression impedance bandwidth is to be interpreted as referring to a frequency region over which a wireless handheld or portable device and a radiating system comply with certain specifications, depending on the service for which the wireless device is adapted. For example, for a device adapted to transmit and receive signals of cellular communication standards, a radiating system having a relative impedance bandwidth capable of covering the frequency band associated to a communication standard (for instance an impedance bandwidth around 15% is required to properly cover the communication standards GSM850/900) together with an efficiency of not less than 20% (advantageously not less than 30%, more advantageously not less than 40%) are preferred. Also, an input return loss of 4.4 dB (equivalent to a VSWR=4) or better within the corresponding frequency band is preferred.

According to an aspect of the present invention, the radiating system comprises a radiating structure and a radiofrequency system. The radiating structure comprises a first radiation booster, a second radiation booster, and a ground plane layer capable of supporting at least one efficient radiation mode. A first connection point of the first radiation booster defines together with a connection point of the ground plane layer a first internal port. A second connection point of the second radiation booster defines together with a connection point of the ground plane layer a second internal port. First and second internal ports are connected to the radiofrequency system which includes a first reactance cancellation element and a second reactance cancellation element. Said reactance cancellation elements can be either capacitive or inductive as a function of the impedance response measured at each internal port of the radiating structure. In this sense, if the input impedance measured at an internal port of the radiating structure presents an inductive behavior, a capacitive reactive element is used to compensate said inductive behavior in at least one frequency region of operation, whereas if the input impedance measured at an internal port of the radiating structure presents a capacitive behavior, an inductive reactive element is used to compensate said capacitive behavior in at least one frequency region of operation.

According to an aspect of the present invention, the first radiation booster is connected to a first reactance cancellation element to compensate its reactive behavior in a first frequency region of operation, whereas the second radiation booster is connected to a second reactance cancellation element to compensate its reactive behavior in a second frequency region of operation. A delay element to produce a difference in phase between the input impedances measured after the addition of the reactance cancellation elements is used to minimize the reflection coefficient measured at the external port of the radiating system in at least two frequency regions of the electromagnetic spectrum. After the addition of the radiofrequency system to the radiating structure, the radiating system operates in at least two frequency bands, each one allocated in a different frequency region of the electromagnetic spectrum, and/or provides additional operating frequency bands in at least one frequency region of the electromagnetic spectrum, and/or provides additional operating frequency bands in the at least two frequency regions of operation.

In some cases, the operating impedance bandwidth of a particular radiation booster measured after the addition of a reactance cancellation element is substantially smaller than that required for covering a communication standard allocated in a particular frequency band. When the internal ports are connected to a radiofrequency system according to the present invention, the radiating system enhances the impedance bandwidth in at least two frequency regions of operation of the electromagnetic spectrum, thus allowing the operation of the radiating system in at least two frequency bands, each one allocated in at least one frequency region of the electromagnetic spectrum.

In some cases, said phase difference minimizes the reflection coefficient measured at the external port of the radiating system in at least one frequency region of the electromagnetic spectrum.

In some further examples, the addition of a radiofrequency system according to the present invention provides additional frequency bands in at least one frequency region of the electromagnetic spectrum. Namely, when the radiating structure is capable of providing operation in at least one frequency band allocated in at least one frequency region of the electromagnetic spectrum, the radiofrequency system increases the number of operating frequency bands in at least said frequency region.

In some cases, the addition of a radiofrequency system according to the present invention provides additional frequency bands in at least two frequency regions of the electromagnetic spectrum. Namely, when the radiating structure is capable of providing operation in at least one frequency band allocated in each of the at least two frequency regions of operation, the radiofrequency system increases the number of operating frequency bands in said at least two frequency regions.

In the context of this document, reactance cancellation preferably refers to compensate the imaginary part of the input impedance at an internal port of the radiating structure when disconnected from the radiofrequency system so that the input impedance of the radiating system at an external port has an imaginary part substantially close to zero for a frequency preferably within a frequency region of operation (such as for instance, the first or the second frequency regions). In some less preferred examples, said frequency may also be higher than the highest frequency of said frequency region (although preferably not higher than 1.1, 1.2, 1.3 or 1.4 times said highest frequency) or lower than the lowest frequency of said frequency region (although preferably not lower than 0.9, 0.8 or 0.7 times said lowest frequency). Moreover, the imaginary part of an impedance is considered to be substantially close to zero if it is not larger (in absolute value) than 15 Ohms, and preferably not larger than 10 Ohms, and more preferably not larger than 5 Ohms.

According to a second aspect of the present invention, the radiating structure comprises a first radiating element tuned to a first frequency region of operation of the radiating system and a second radiating element tuned to a second frequency region of operation of the radiating system. A delay element is provided between the first internal port and the second internal port of the radiating structure to produce a difference in phase between the input impedances measured at each one of the internal ports of the radiating structure. Said phase difference is used to minimize the reflection coefficient measured at the external port of the radiating system in at least two frequency regions of the electromagnetic spectrum. After the addition of the radiofrequency system to the radiating structure, the radiating system operates in at least two frequency bands, each one allocated in a different frequency region of the electromagnetic spectrum.

In some cases according to said second aspect, the operating impedance bandwidth of the first radiating element measured at a first internal port (defined between a connection point of the first radiating element and a connection point of the ground plane layer) is not sufficient for covering a frequency band allocated in a first frequency region of the electromagnetic spectrum. At the same time, the operating impedance bandwidth of the second radiating element measured at a second internal port (defined between a connection point of the second radiating element and a connection point of the ground plane layer) is not sufficient for covering a frequency band allocated in a second frequency region of the electromagnetic spectrum. In these cases, the phase difference minimizes the reflection coefficient increasing the impedance bandwidth measured at the external port of the radiating system in at least two frequency regions of the electromagnetic spectrum, thus allowing the operation of the radiating system in at least two frequency bands, each one allocated in at least one frequency region of the electromagnetic spectrum.

In some cases, the phase difference minimizes the reflection coefficient increasing the impedance bandwidth measured at the external port of the radiating system in at least one frequency region of the electromagnetic spectrum.

In some cases, the addition of a radiofrequency system according to the present invention provides additional frequency bands in at least one frequency region of the electromagnetic spectrum. Namely, when the radiating structure is capable of providing operation in at least one frequency band allocated in at least one frequency region of the electromagnetic spectrum, the radiofrequency system increases the number of operating frequency bands in said frequency region.

In some cases, the addition of a radiofrequency system according to the present invention provides additional frequency bands in at least two frequency regions of the electromagnetic spectrum. Namely, when the radiating structure is capable of providing operation in at least one frequency band allocated in each of the at least two frequency regions of operation, the radiofrequency system increases the number of operating frequency bands in said at least two frequency regions.

According to a third aspect of the present invention, the radiating structure comprises a first radiating element tuned to a first frequency region of operation of the radiating system and a second radiation booster connected to a reactance cancellation element to compensate its reactive behavior in a second frequency region of operation. A delay element is provided between the first internal port (defined between a connection point of the ground plane layer and a connection point of the radiating element) and the reactance cancellation element to produce a difference in phase between the two input impedances. Said delay element combines both impedances into a single port and is used to minimize the reflection coefficient measured at the external port of the radiating system in at least two frequency regions of the electromagnetic spectrum. After the addition of the radiofrequency system to the radiating structure, the radiating system operates in at least two frequency bands, each one allocated in a different frequency region of the electromagnetic spectrum.

In some further examples, a radiating element is tuned to a second frequency region whereas a radiation booster is connected to a reactance cancellation element capable of compensating its reactive behavior in a frequency within the first frequency region of operation.

In some embodiments according to the present invention, the radiating system provides operation in at least two frequency bands allocated in a first frequency region of the electromagnetic spectrum and in at least two frequency bands allocated in a second frequency region of the electromagnetic spectrum.

Distributed elements as well as lumped components can be used to produce the required phase difference. According to an aspect of the present invention, distributed elements such as transmission lines (such as for instance, coaxial line, micro-coaxial line, microstrip, stripline, coplanar, ground coplanar . . . ) or alternatively lumped components formed by different stages alternating series inductors and parallel capacitors are preferred. In some other configurations, different stages of series capacitors and shunt inductors are provided.

In a preferred example, the delay element comprises a transmission line. Said transmission line presents a characteristic impedance of 50Ω. In some other embodiments, said characteristic impedance can be optimized to increase the impedance bandwidth at the external port of the radiating system. In these cases, said characteristic impedance is larger than 5Ω, 10Ω, 20Ω, 30Ω, or 40Ω and smaller than 300 Ω, 200Ω, 150Ω, 100Ω, or 75Ω.

In some examples, the delay element comprises a combination of lumped elements and transmissions lines. For example a transmission line using a micro-coaxial cable is cascaded with a series inductor and shunt capacitor. This configuration is suitable for adding design flexibility and for allowing the miniaturization of the transmission line. In some situations, these combinations of transmission lines and lumped elements provide a compact solution having a smaller size than other architectures where only a transmission line is used.

In some other preferred examples, the use of lumped elements or the combination of a transmission line with lumped elements is used to modify the characteristic impedance of the delay element. A characteristic impedance different of 50Ω is preferable for increasing the impedance bandwidth in the at least two frequency regions of operation of the electromagnetic spectrum.

In some preferred examples the difference in phase introduced by the delay element is substantially close to 90° at the lowest frequency of the first frequency region. The phase can be adjusted to create input impedance loops at the external port of the radiating system. If said at least two impedance loops associated to each frequency regions are not centered at the center of the Smith chart, a further stage (fine tuning network) is added to locate said impedance loops at the center of the Smith chart in order to provide enough impedance bandwidth as for covering at least two frequency bands, each one allocated in a separate frequency region of the electromagnetic spectrum.

In some examples the modulus of the phase of the delay element is larger than 40°, 50°, 60°, 70°, or 80° at the lowest frequency of the first frequency region. In some other examples the modulus of the phase of the delay element is lower than 150°, 140°, 130°, 120°, 110°, or 100° at the lowest frequency of the first frequency region.

Radiating structures composed by radiation boosters and small radiating elements are preferable for solving the space limitations found in current wireless handheld or portable devices. In addition, the complexity found in prior radiofrequency systems is solved by a radiofrequency system according to the present invention where a reduced number of elements are used. This simplicity reduces losses, increases robustness to tolerances and facilitates its integration into a wireless handheld or portable device.

In some embodiments, the radiofrequency system further comprises a fine tuning stage, namely a reactive matching network connected between the phase delay element and the external port of the radiating system. Said fine tuning stage is used to transform the input impedance of the radiating structure, providing impedance matching to the radiating system in at least the first and second frequency regions of operation of the radiating system.

The fine tuning stage is preferred when the delay element does not substantially minimize the sum of reflection coefficients at the external port of the radiating system but provide compact impedance loops in the two frequency regions of operation. In this case, a fine tuning stage is used to center said compact impedance loops to the particular specifications of the radiating system, such as for instance to a VSWR≤4 and preferably to a VSWR≤3.

In a preferred example, the radiofrequency system comprises as many reactance cancellation elements as there are radiation boosters (and, consequently, internal ports) in the radiating structure.

A fine tuning stage can comprise a single stage or a plurality of stages. In some examples, the fine tuning stage comprises at least two, at least three, at least four, at least five, at least six, at least seven, at least eight or more stages.

A stage comprises one or more circuit components (such as for example but not limited to inductors, capacitors, resistors, jumpers, short-circuits, switches, delay lines, resonators, or other reactive or resistive components). In some cases, a stage has a substantially inductive behavior in the frequency regions of operation of the radiating system, while another stage has a substantially capacitive behavior in said frequency regions, and yet a third one may have a substantially resistive behavior in said frequency regions.

A stage can be connected in series or in parallel to other stages and/or to one of the at least one port of the radiofrequency system.

In some examples, the at least one fine tuning stage alternates stages connected in series (i.e., cascaded) with stages connected in parallel (i.e., shunted), forming a ladder structure. In some cases, a fine tuning stage comprising two stages forms an L-shaped structure (i.e., series-parallel or parallel-series). In some other cases, a fine tuning stage comprising three stages forms either a pi-shaped structure (i.e., parallel-series-parallel) or a T-shaped structure (i.e., series-parallel-series).

In some examples, the at least one fine tuning stage alternates stages having a substantially inductive behavior, with stages having a substantially capacitive behavior.

In an example, the at least one fine tuning stage or the delay element comprise at least one active circuit component (such as for instance, but not limited to, a transistor, a diode, a MEMS device, a relay, a phase shifter, or an amplifier) in at least one stage.

In some examples, the radiofrequency system or at least one of the stages of the radiofrequency system may be integrated into an integrated circuit, such as for instance a CMOS integrated circuit or a hybrid integrated circuit.

An aspect of the present invention relates to the use of the ground plane layer of the radiating structure as an efficient radiator to provide an enhanced radioelectric performance in two or more frequency regions of operation of the wireless handheld or portable device, eliminating thus the need for a multiband antenna element having a complex geometry. Different radiation modes of the ground plane layer can be advantageously excited when a dimension of said ground plane layer is on the order of, or even larger than, one half of the wavelength corresponding to a frequency of operation of the radiating system.

Therefore, in a wireless handheld or portable device comprising radiation boosters according to the present invention, the mode or modes excited in the ground plane have significant contribution to the radiation process. Nevertheless, when resonant radiating elements are used, the resulting radiation becomes the combination between the radiation provided by the mode or modes excited in the radiating element and the mode or modes excited in the ground plane.

In some embodiments, at least one, two, three, or even all, of said radiation modes occur at frequencies advantageously located above (i.e., at a frequency higher than) the first frequency region of operation of the wireless handheld or portable device. In some other embodiments, the frequency of at least one radiation mode of said ground plane layer is within said first frequency region. In some further embodiments, the frequency of at least one radiation mode of said ground plane layer is located below said first frequency region.

In some embodiments, at least one, two, or three, radiation modes of the ground plane layer is/are advantageously located above the second frequency region of operation of the wireless handheld or portable device.

A ground plane rectangle is defined as being the minimum-sized rectangle that encompasses a ground plane layer of the radiating structure. That is, the ground plane rectangle is a rectangle whose sides are tangent to at least one point of said ground plane layer.

In some cases, the ratio between a side of the ground plane rectangle, preferably a long side of the ground plane rectangle, and the free-space wavelength corresponding to the lowest frequency of the first frequency region is advantageously larger than a minimum ratio. Some possible minimum ratios are 0.1, 0.16, 0.2, 0.3, 0.4, 0.5, 0.6, 0.8, 1, 1.2 and 1.4. Said ratio may additionally be smaller than a maximum ratio (i.e., said ratio may be larger than a minimum ratio but smaller than a maximum ratio). Some possible maximum ratios are 0.4, 0.5, 0.6, 0.8, 1, 1.2, 1.4, 1.6, 2, 3, 4, 5, 6, 8 and 10.

Setting a dimension of the ground plane rectangle, preferably the dimension of its long side, relative to said free-space wavelength within these ranges makes it possible for the ground plane layer to support one, two, three or more efficient radiation modes, in which the currents flowing on the ground plane layer are substantially aligned and contribute in phase to the radiation process.

The gain of a radiating structure depends on factors such as its directivity, its radiation efficiency and its input return loss. Both the radiation efficiency and the input return loss of the radiating structure are frequency dependent (even directivity is strictly frequency dependent). A radiating structure is usually very efficient around the frequency of a radiation mode excited in the ground plane layer and maintains a similar radioelectric performance within the frequency range defined by its impedance bandwidth around said frequency. Since the dimensions of the ground plane layer (or those of the ground plane rectangle) are comparable to, or larger than, the wavelength at the frequencies of operation of the wireless device, said radiation mode may be efficient over a broad range of frequencies.

A wireless handheld or portable device generally comprises one, two, three or more multilayer printed circuit boards (PCBs) on which to carry the electronics. In a preferred embodiment of a wireless handheld or portable device, the ground plane layer of the radiating structure is at least partially, or completely, contained in at least one of the layers of a multilayer PCB.

In some cases, a wireless handheld or portable device may comprise two, three, four or more ground plane layers. For example a clamshell, flip-type, swivel-type or slider-type wireless device may advantageously comprise two PCBs, each including a ground plane layer.

Each radiation booster or each radiating element advantageously couples the electromagnetic energy from the radiofrequency system to the ground plane layer in transmission, and from the ground plane layer to the radiofrequency system in reception.

In some examples, the/each radiation booster has a maximum size smaller than 1/30, 1/40, 1/50, 1/60, 1/80, 1/100, 1/140 or even 1/180 times the free-space wavelength corresponding to the lowest frequency of the first frequency region of operation of the wireless handheld or portable device.

In some further examples, at least one (such as for instance, one, two, three or more) radiation booster has a maximum size smaller than 1/30, 1/40, 1/50, 1/60, 1/80, 1/100, 1/140 or even 1/180 times the free-space wavelength corresponding to the lowest frequency of the second frequency region of operation of said device.

In some examples, the/each radiating element has a maximum size smaller than 1/10, 1/15, 1/20, or even 1/25 times the free-space wavelength corresponding to the lowest frequency of the first frequency region of operation of the wireless handheld or portable device.

In some further examples, at least one (such as for instance, one, two, three or more) radiating elements has a maximum size smaller than 1/10, 1/15, 1/20, or even 1/25 times the free-space wavelength corresponding to the lowest frequency of the second frequency region of operation of said device.

Setting the dimensions of the/each radiation booster to such small values is advantageous because the radiation booster substantially behaves as a non-radiating element for all the frequencies of the first and second frequency regions, thus substantially reducing the loss of energy into free space due to undesired radiation effects of the radiation booster, and consequently enhancing the transfer of energy between the radiation booster and the ground plane layer. Therefore, the skilled-in-the-art person could not possibly regard the/each radiation booster as being an antenna element.

At the same time, setting the dimensions of the radiating element to such maximum values is advantageous to minimize the volume required in the wireless handheld or portable device. Said maximum size ensures the integration of other components into the wireless handheld or portable devices while minimizes undesired coupling effects.

The maximum size of a radiation booster or radiating element is preferably defined by the largest dimension of a booster box or radiating box, respectively, that completely encloses said radiation booster or radiating element, and in which the radiation booster or radiating element is inscribed.

More specifically, a booster box or radiating box for a radiation booster or radiating element is defined as being the minimum-sized parallelepiped of square or rectangular faces that completely encloses the radiation booster or radiating element, respectively, and wherein each one of the faces of said minimum-sized parallelepiped is tangent to at least a point of said radiation booster or radiating element, respectively. Moreover, each possible pair of faces of said minimum-size parallelepiped sharing an edge forms an inner angle of 90°.

In those cases in which the radiating structure comprises more than one radiation booster or radiating element, a different booster box or radiating box is defined for each of them.

In some examples, one of the dimensions of a booster box or radiating box can be substantially smaller than any of the other two dimensions, or even be close to zero. In such cases, said booster box collapses to a practically two-dimensional entity. The term dimension preferably refers to an edge between two faces of said parallelepiped.

Additionally, in some of these examples the/each radiation booster has a maximum size larger than 1/1400, 1/700, 1/350, 1/250, 1/180, 1/140 or 1/120 times the free-space wavelength corresponding to the lowest frequency of said first frequency region. Therefore, in some examples the/each radiation booster has a maximum size advantageously smaller than a first fraction of the free-space wavelength corresponding to the lowest frequency of the first frequency region but larger than a second fraction of said free-space wavelength.

Furthermore, in some of these examples, at least one, two, or three radiation boosters have a maximum size larger than 1/1400, 1/700, 1/350, 1/175, 1/120, or 1/90 times the free-space wavelength corresponding to the lowest frequency of the second frequency region of operation of the wireless handheld or portable device.

Additionally, in some of these examples the/each radiating element has a maximum size larger than 1/30 1/40, 1/50, 1/60, 1/80, 1/100, 1/140 or even 1/180 times the free-space wavelength corresponding to the lowest frequency of said first frequency region. Therefore, in some examples the/each radiating element has a maximum size advantageously smaller than a first fraction of the free-space wavelength corresponding to the lowest frequency of the first frequency region but larger than a second fraction of said free-space wavelength.

Furthermore, in some of these examples, at least one, two, or three radiating elements have a maximum size larger than 1/30, 1/40, 1/50, 1/60, 1/80, 1/100, 1/140 or even 1/180 times the free-space wavelength corresponding to the lowest frequency of the second frequency region of operation of the wireless handheld or portable device.

Setting the dimensions of a radiation booster or radiating element to be above some certain minimum value is advantageous to obtain a higher level of the real part of the input impedance of the radiating structure (measured at the internal port of the radiating structure associated to said radiation booster or radiating element when disconnected from the radiofrequency system) and in this way enhance the transfer of energy between said radiation booster or radiating element and the ground plane layer.

In some other cases, preferably in combination with the above feature of an upper bound for the maximum size of a radiation booster or the maximum size of the radiating element although not always required, to reduce even further the losses in a radiation booster or radiating element due to residual radiation effects.

In some examples the at least one radiation booster or at least one radiating element is substantially planar defining a two-dimensional structure, while in other cases the at least one radiation booster or at least one radiating element is a three-dimensional structure that occupies a volume. Radiation boosters or radiating elements being substantially planar are preferred for being integrated in ultra-slim wireless handheld or portable devices. Radiation boosters or radiating elements having a volumetric geometric may be advantageous to enhance the radioelectric performance of the radiating structure, particularly in those cases in which the maximum size of the radiation booster or the radiating element is very small relative to the free-space wavelength corresponding to the lowest frequency of the first and/or second frequency region.

Therefore, in some examples in which the at least one radiation booster has a volumetric geometry, it is preferred to set a ratio between the first resonant frequency associated to the/each internal port of the radiating structure when disconnected from the radiofrequency system and the highest frequency of the first frequency region above 4.8, or even above 5.4.

In some advantageous examples, the radiating structure includes a first radiation booster having a volumetric geometry and a second radiation booster being substantially planar. In such examples, said first radiation booster may preferably excite a radiation mode on the ground plane layer responsible for the operation of the radiating system in the first frequency region. In some examples in which the at least one radiation booster has a planar geometry, it is preferred to set a ratio between the first resonant frequency associated to the/each internal port of the radiating structure when disconnected from the radiofrequency system and the highest frequency of the first frequency region above 4.8, or even above 5.4. At the same time, the second radiation booster may preferably excite a radiation mode on the ground plane layer responsible for the operation of the radiating system in the second frequency region.

In a preferred embodiment, the at least one radiation booster or radiating element comprises a conductive part. In some cases said conductive part may take the form of, for instance but not limited to, a conducting strip comprising one or more segments, a polygonal shape (including for instance triangles, squares, rectangles, hexagons, or even circles or ellipses as limit cases of polygons with a large number of edges), a polyhedral shape comprising a plurality of faces (including also cylinders or spheres as limit cases of polyhedrons with a large number of faces), or a combination thereof.

In some examples, the connection point of the at least one radiation booster or at least one radiating element is advantageously located substantially close to an end, or to a corner, of said conductive part.

In another preferred example, the at least one radiation booster or the at least one radiating element comprises a gap (i.e., absence of conducting material) defined in the ground plane layer. Said gap is delimited by one or more segments defining a curve. The connection point of the radiation booster is located at a first point along said curve. The connection point of the ground plane layer is located at a second point along said curve, said second point being different from said first point.

In another preferred example, the radiating element or radiation booster may be miniaturized by shaping at least a portion of radiating element or radiation booster as a space-filling curve.

In another example, at least a portion of one or more of the radiating elements may be coupled, either through direct contact or electromagnetic coupling, to a conducting surface, such as a conducting polygon or multilevel surface. Further, the radiating element may include the shape of a multilevel structure.

In other preferred examples, the radiating elements are formed by a single radiating arm, whereas in other examples they can be formed by multiple radiating arms.

In a preferred example of the present invention, a major portion of the at least one radiation booster or radiating element (such as at least a 50%, or a 60%, or a 70%, or an 80% of the surface of said radiation booster or radiating element) is placed on one or more planes substantially parallel to the ground plane layer. In the context of this document, two surfaces are considered to be substantially parallel if the smallest angle between a first line normal to one of the two surfaces and a second line normal to the other of the two surfaces is not larger than 30°, and preferably not larger than 20°, or even more preferably not larger than 10°.

In some examples, said one or more planes substantially parallel to the ground plane layer and containing a major portion of a radiation booster or radiating element of the radiating structure are preferably at a height with respect to said ground plane layer not larger than a 2% of the free-space wavelength corresponding to the lowest frequency of the first frequency region of operation of the radiating system. In some cases, said height is smaller than 7 mm, preferably smaller than 5 mm, and more preferably smaller than 3 mm.

In some embodiments, the at least one radiation booster or the at least one radiating element are substantially coplanar to the ground plane layer. Furthermore, in some cases the at least one radiation booster or the at least one radiating element is advantageously embedded in the same PCB as the one containing the ground plane layer, which results in a radiating structure having a very low profile.

In some cases at least two, three, four, or even all, radiation boosters or at least two, three, four, or even all, radiating elements are substantially coplanar to each other, and preferably also substantially coplanar to the ground plane layer.

In some case at least one radiation booster and at least one radiating element are substantially coplanar to each other, and preferably also substantially coplanar to the ground plane layer.

In some cases, two or more radiation boosters or radiating elements may be arranged one on top of another forming for example a stacked configuration. In other cases, at least one radiation booster or radiating element is arranged or embedded within another radiation booster or radiating element (i.e., the booster box or radiating box of said at least one radiation booster or radiating element is at least partially contained within the booster box or radiating box of said another radiation booster or radiating element). In such cases, even more compact solutions can be obtained.

In a preferred example the radiating structure is arranged within the wireless handheld or portable device in such a manner that there is no ground plane in the orthogonal projection of a radiation booster or radiating element onto the plane containing the ground plane layer. In some examples there is some overlapping between the projection of a radiation booster or a radiating element and the ground plane layer. In some embodiments less than a 10%, a 20%, a 30%, a 40%, a 50%, a 60% or even a 70% of the area of the projection of a radiation booster or a radiating element overlaps the ground plane layer. Yet in some other examples, the projection of a radiation booster or a radiating element onto the ground plane layer completely overlaps the ground plane layer.

In some cases it is advantageous to protrude at least a portion of the orthogonal projection of a radiation booster or a radiating element beyond the ground plane layer, or alternatively remove ground plane from at least a portion of the projection of a radiation booster or radiating element, in order to adjust the levels of impedance and to enhance the impedance bandwidth of the radiating structure. This aspect is particularly suitable for those examples when the volume for the integration of the radiating structure has a small height, as it is the case in particular for slim wireless handheld or portable devices.

In some examples, at least one, two, three, or even all, radiation boosters or radiating elements are preferably located substantially close to an edge of the ground plane layer, preferably said edge being in common with a side of the ground plane rectangle. In some examples, at least one radiation booster or at least one radiating element is more preferably located substantially close to an end of said edge or to the middle point of said edge.

In some embodiments said edge is preferably an edge of a substantially rectangular or elongated ground plane layer.

In an example, a radiation booster is located preferably substantially close to a short side of the ground plane rectangle, and more preferably substantially close to an end of said short side or to the middle point of said short side. Such a placement for a radiation booster with respect to the ground plane layer is particularly advantageous when the radiating structure features at the internal port associated to said radiation booster, when the radiofrequency system is disconnected, an input impedance having a capacitive component for the frequencies of the first and second frequency regions of operation.

In another example, a radiation booster is located preferably substantially close to a long side of the ground plane rectangle, and more preferably substantially close to an end of said long side or to the middle point of said long side. Such a placement for a radiation booster is particularly advantageous when the radiating structure features at the internal port associated to said radiation booster, when the radiofrequency system is disconnected, an input impedance having an inductive component for the frequencies of said first and second frequency regions.

In some other examples, at least one radiation booster or the at least one radiating element is advantageously located substantially close to a corner of the ground plane layer, preferably said corner being in common with a corner of the ground plane rectangle.

In the context of this document, two points are substantially close to each other if the distance between them is less than 5% (more preferably less than 3%, 2%, 1% or 0.5%) of the free-space wavelength corresponding to the lowest frequency of operation of the radiating system. In the same way, two linear dimensions are substantially close to each other if they differ in less than 5% (more preferably less than 3%, 2%, 1% or 0.5%) of said free-space wavelength.

In an advantageous example, a first radiation booster is substantially close to a first corner of the ground plane layer and a second radiation booster is substantially close to a second corner of the ground plane layer (said second corner not being the same as said first corner). The first and second corners are preferably in common with two corners of the ground plane rectangle associated to said ground plane layer and, more preferably, said two corners are at opposite ends of a short side of the ground plane rectangle.

In another advantageous example, a first radiation booster is arranged substantially close to a first corner of the ground plane layer, the first corner being preferably in common with a corner of the ground plane rectangle, whereas a second radiation booster is arranged substantially close to a middle point of a large edge of the ground plane. In this example, preferably, the first radiation boosters is such that the first internal port, when the radiofrequency system is disconnected, features an input impedance having a capacitive component for the frequencies of the first and second frequency regions, whereas the second radiation booster is such that the second internal port, also when the radiofrequency system is disconnected, features an input impedance having an inductive component for the frequencies of the first and second frequency regions.

In some examples, the at least one connection point of the ground plane layer is located advantageously close to the connection point of one of the at least one radiation boosters or to the connection point of one of the at least one radiating element to facilitate the interconnection of the radiofrequency system with the radiating structure. Therefore, those locations specified above as being preferred for the placement of a radiation booster or radiating element are also advantageous for the location of the at least one connection point of the ground plane layer. Therefore, in some examples said at least one connection point is located substantially close to an edge of the ground plane layer, preferably an edge in common with a side of the ground plane rectangle, or substantially close to a corner of the ground plane layer, preferably said corner being in common with a corner of the ground plane rectangle. Such an election of the position of the at least one connection point of the ground plane layer may be advantageous to provide a longer path to the electrical currents flowing on the ground plane layer, lowering the frequency of one or more radiation modes of the ground plane layer.

In some examples the ground plane associated to a radiating structure is the ground plane layer of a mobile phone, or of a tablet device, or of a laptop device, or of a navigator device, or of a point-of-sale device, or of a dongle device.

BRIEF DESCRIPTION OF THE DRAWINGS

Embodiments of the invention are shown in the enclosed figures. Herein shows.

Input impedance after connection of a first reactance cancellation element to the first internal port; (c) Input impedance after connection of a second reactance cancellation element to the second internal port; (d) Input impedance after the addition of a delay element to the second reactance cancellation element; (e) Input impedance after the interconnection of the first reactance cancellation element and the delay element; (f) Input impedance measured at the external port of the radiating system after the addition of a fine tuning stage.

Figure 4A:
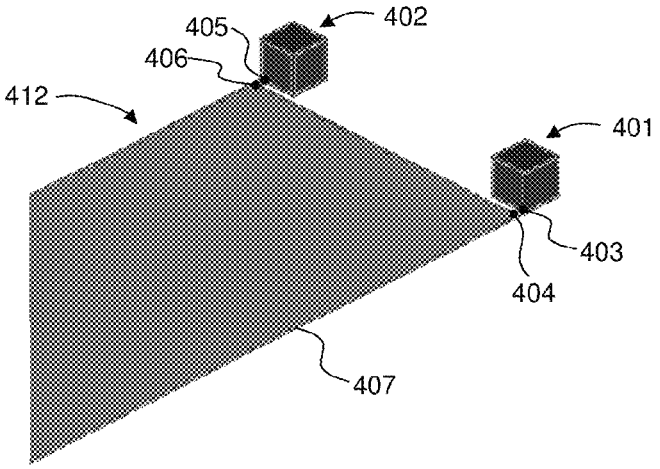
FIG. 4—Example of a radiating structure for a radiating system, the radiating structure including a first and a second radiation booster, each one comprising a conductive part: (a) Partial perspective view; and (b) top plan view.
Figure 4B:
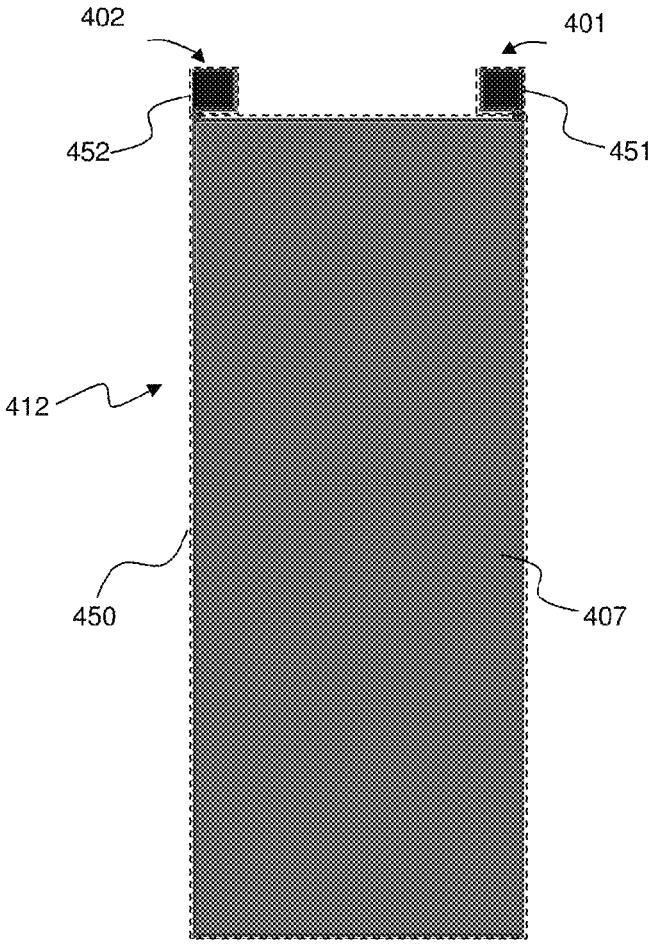
Figure 5:
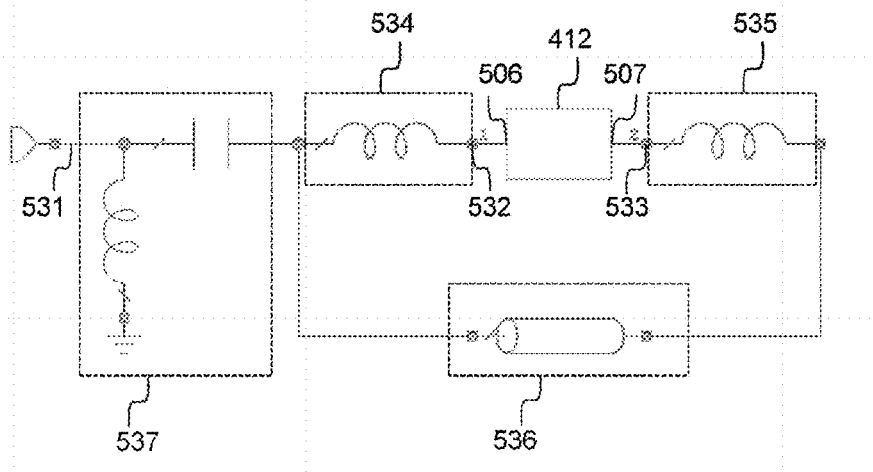
FIG. 5—Schematic representation of a radiofrequency system for a radiating system whose radiating structure is shown in FIG. 4.
Figure 7:
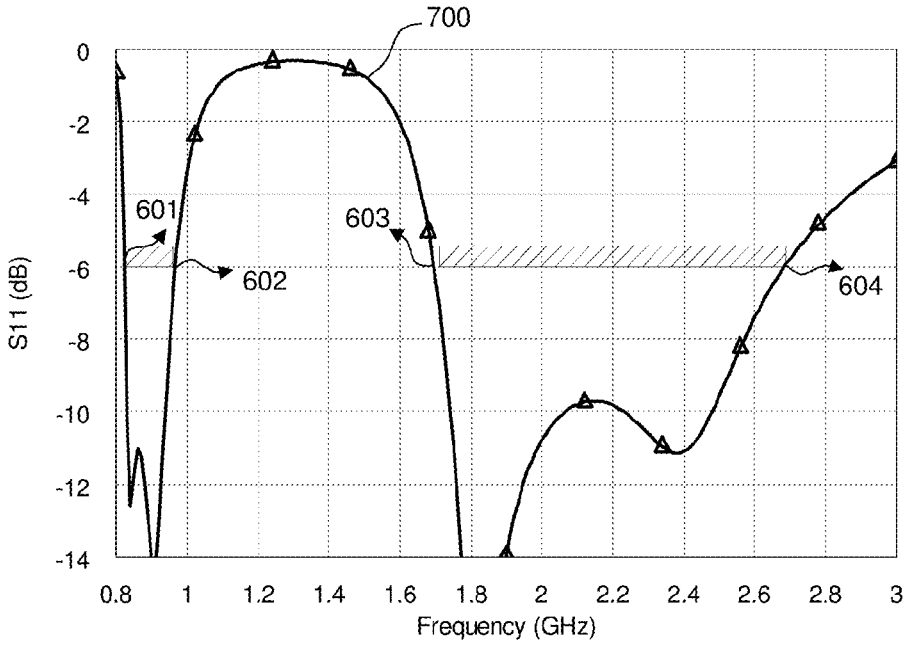

FIG. 7—Reflection coefficient measured at the external port of the radiating system resulting from the interconnection of the radiofrequency system of FIG. 5 to the radiating structure of FIG. 4.

Figure 8:
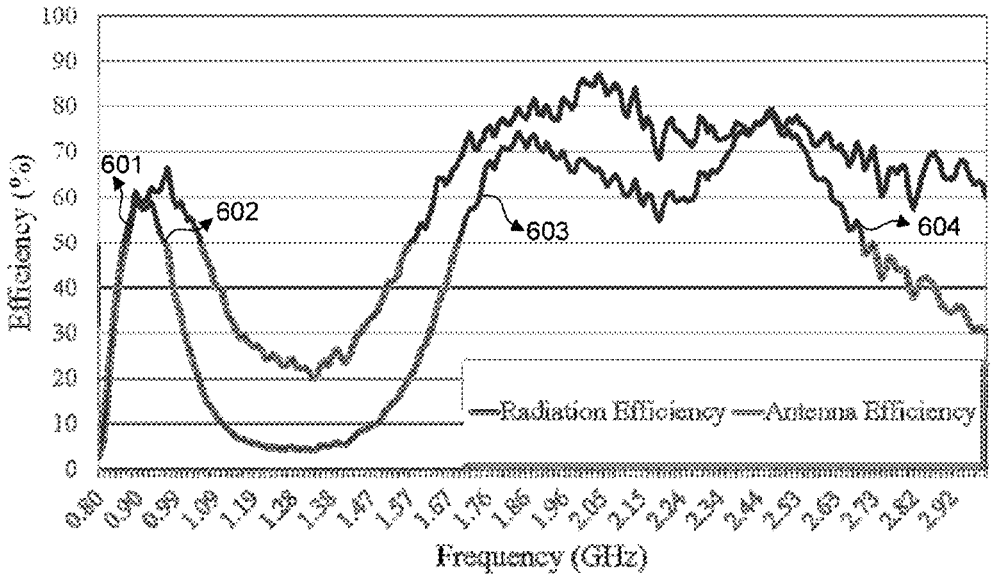

FIG. 8—Antenna and radiation efficiency measured at the external port of the radiating system resulting from the interconnection of the radiofrequency system of FIG. 5 to the radiating structure of FIG. 4.

Figure 9A:
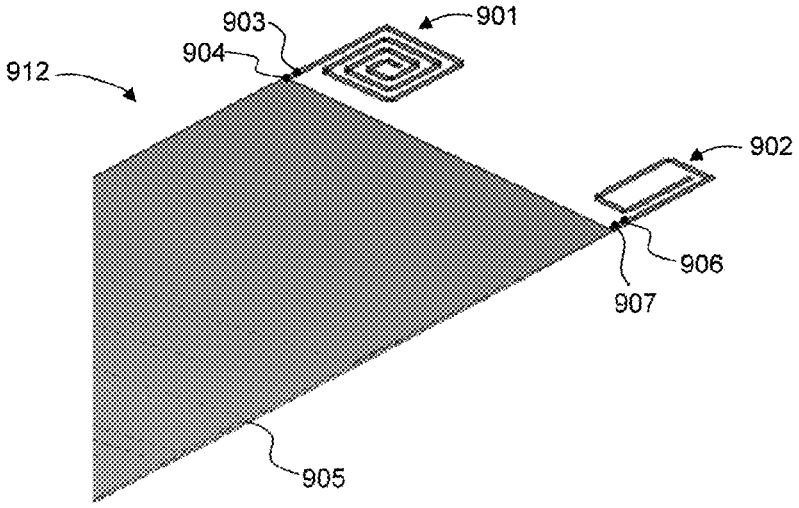

FIG. 9—Example of a radiating structure for a radiating system, the radiating structure including a first and a second radiating element, each one comprising a conductive part: (a) Partial perspective view; and (b) top plan view.

Figure 9B:
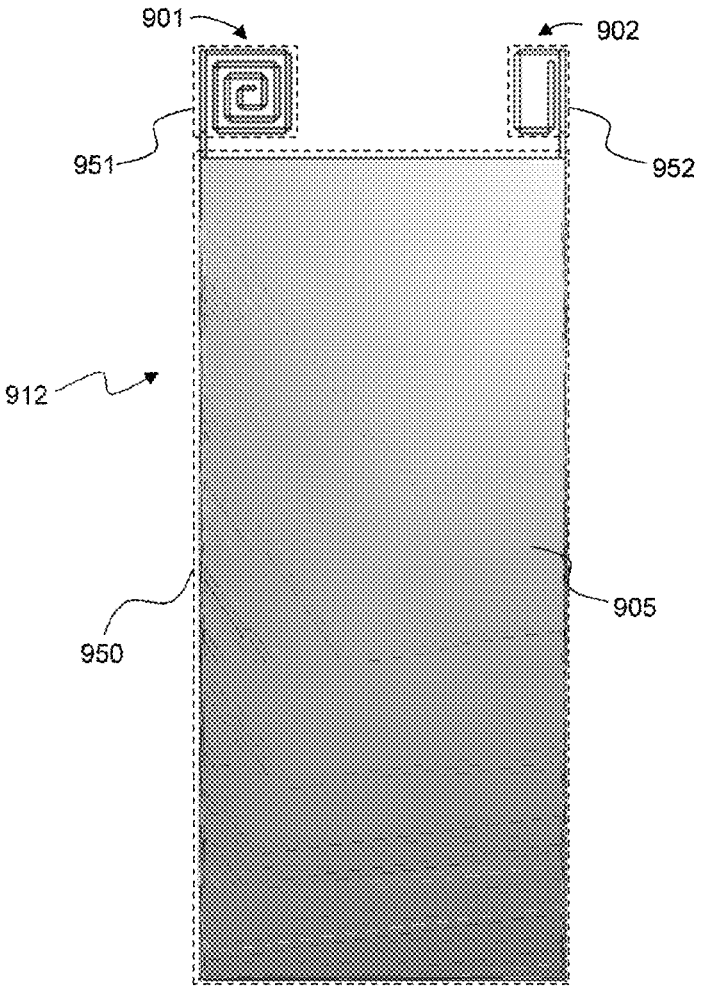
Figure 10:
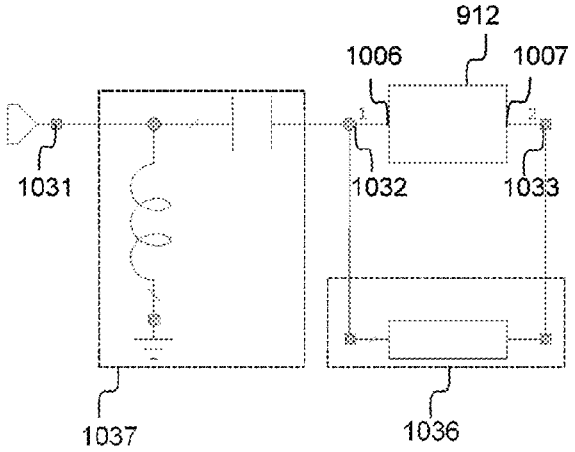

FIG. 10—Schematic representation of a radiofrequency system for a radiating system whose radiating structure is shown in FIG. 9.

FIG. 11—Typical impedance transformation caused by the radiofrequency system depicted in FIG. 10 on the input impedance of the radiating structure of FIG. 9: (a) Input impedance at the first internal port when disconnected from the radiofrequency system; (b) Input impedance at the second internal port when disconnected from the radiofrequency system; (c) Input impedance after the addition of a delay element to the second internal port; (d) Input impedance after the interconnection of the first internal port to the delay element; (e) Input impedance measured at the external port of the radiating system after the addition of a fine tuning stage; (f) Reflection coefficient measured at the external port of the radiating system resulting from the interconnection of the radiofrequency system of FIG. 10 to the radiating structure of FIG. 9.

Figure 12:
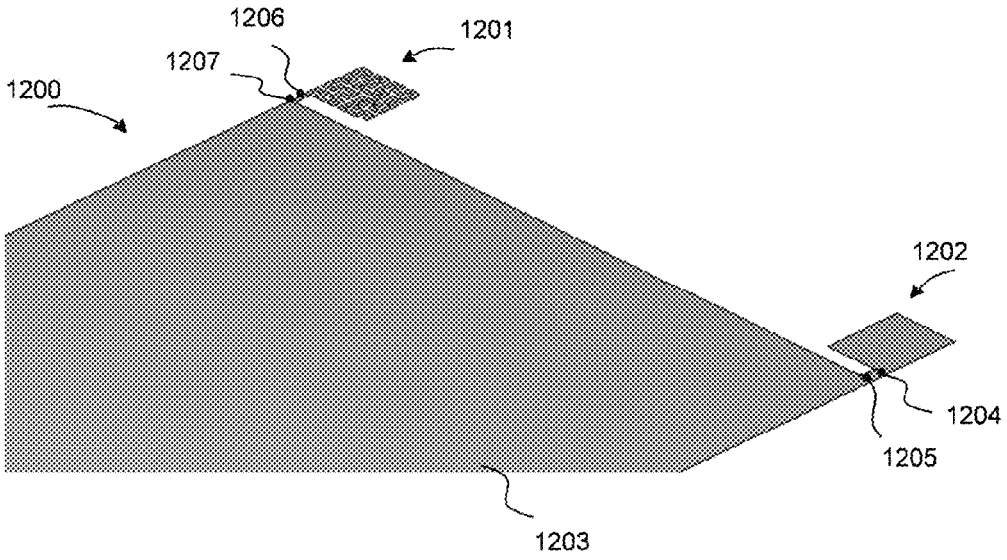

FIG. 12—Example of a radiating structure for a radiating system, the radiating structure including a first and a second planar radiation booster, each one comprising a conductive part and having a different geometry.

Figure 13:
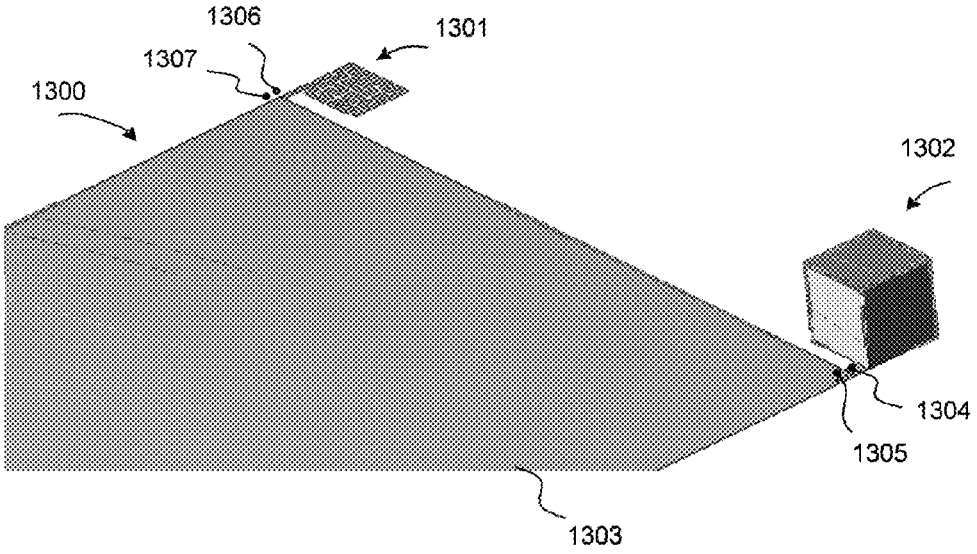

FIG. 13—Example of a radiating structure for a radiating system, the radiating structure including a first planar radiation booster and a second volumetric radiation booster, each one comprising a conductive part.

Figure 14:
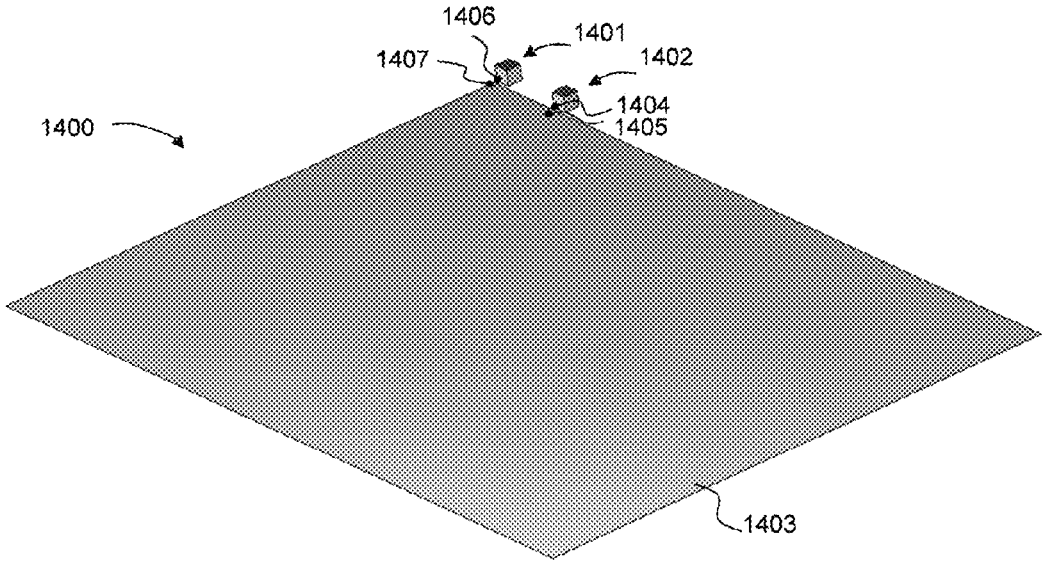

FIG. 14—Example of a radiating structure for a radiating system, the radiating structure including a first and a second volumetric radiation booster, each one comprising a conductive part integrated in an e-tablet.

Figure 15:
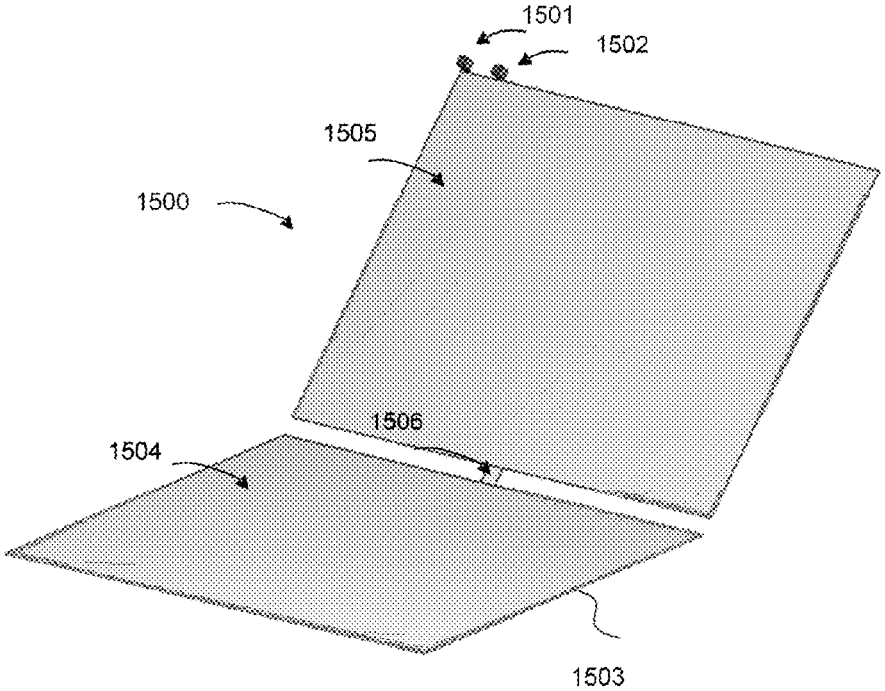

FIG. 15—Example of a radiating structure for a radiating system, the radiating structure including a first and a second volumetric radiation booster, each one comprising a conductive part integrated in a laptop device.

Figure 16A:
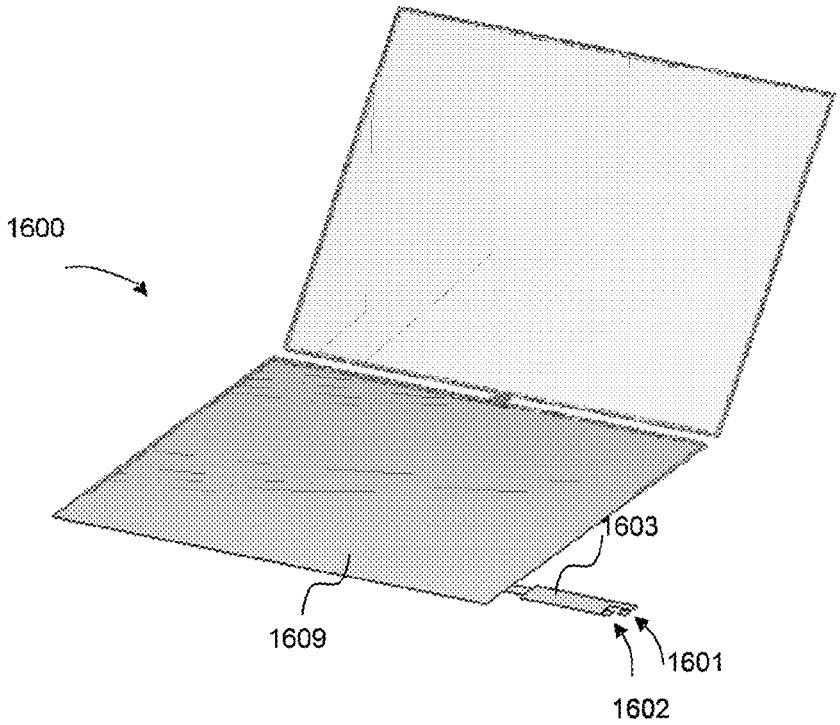

FIG. 16*a*—Example of a radiating structure for a radiating system, the radiating structure including first and second planar radiation boosters, each one comprising a conductive part and each one integrated in a dongle device.

Figure 16B:
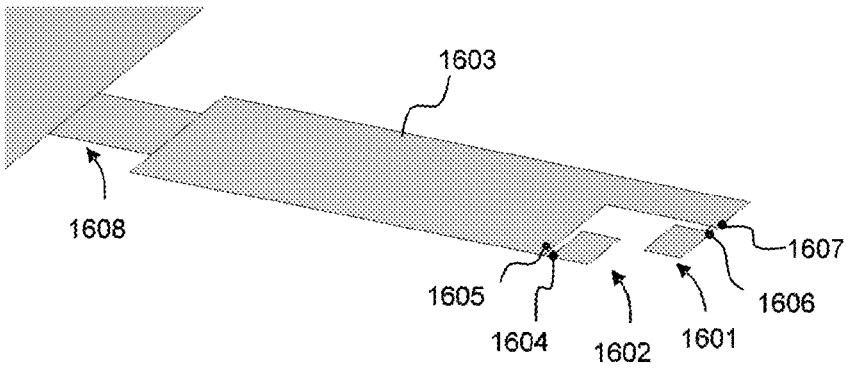

FIG. 16*b* is a magnified view of the first and second planar radiation boosters shown in FIG. 16*a*.

Figure 17:
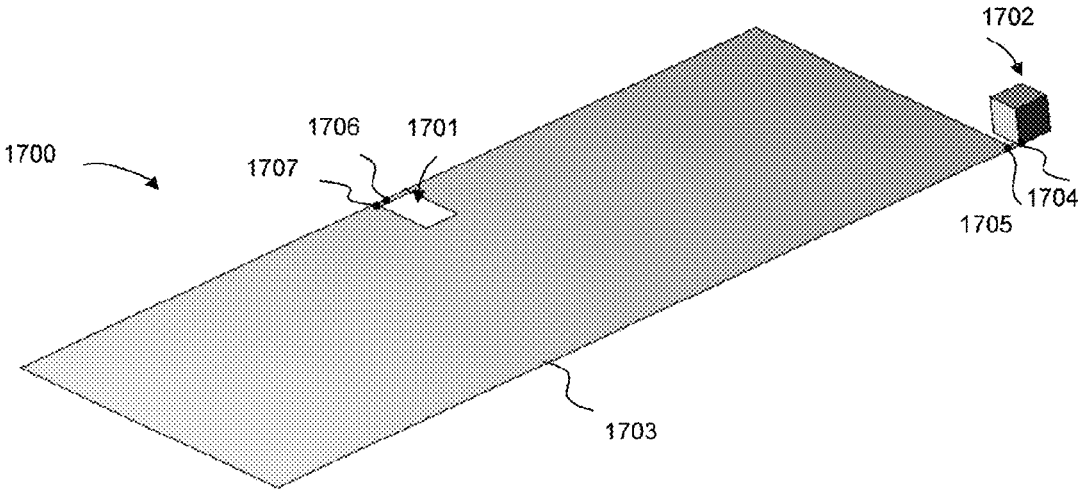

FIG. 17—Example of a radiating structure for a radiating system, the radiating structure including a first and a second radiation booster, one comprising a conductive part and the other comprising a gap (absence of conducting material) in the ground plane.

Figure 18:
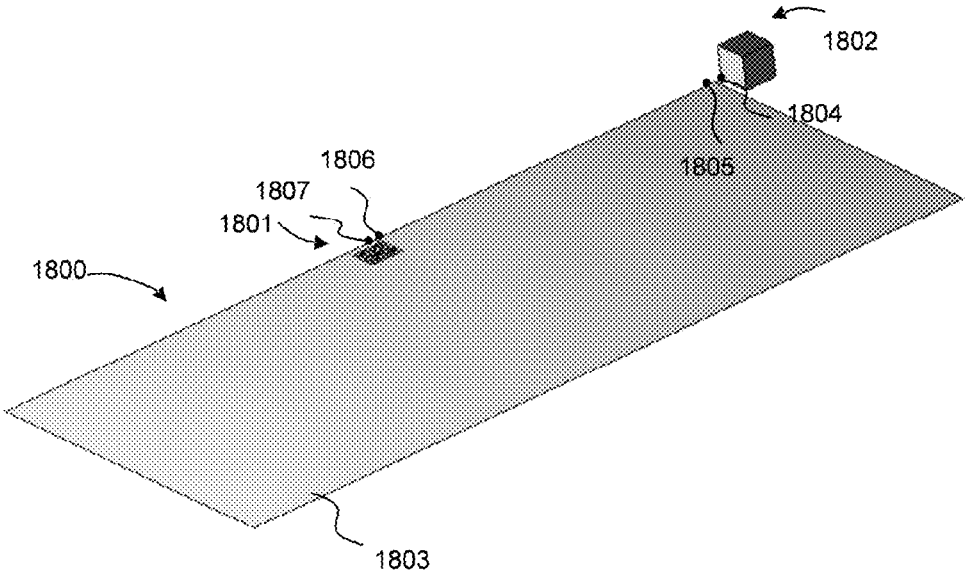

FIG. 18—Example of a radiating structure for a radiating system, the radiating structure including a first and a second radiation booster, one comprising a conductive part and the other comprising a gap in the ground plane inspired in space-filling curves.

Figure 19:
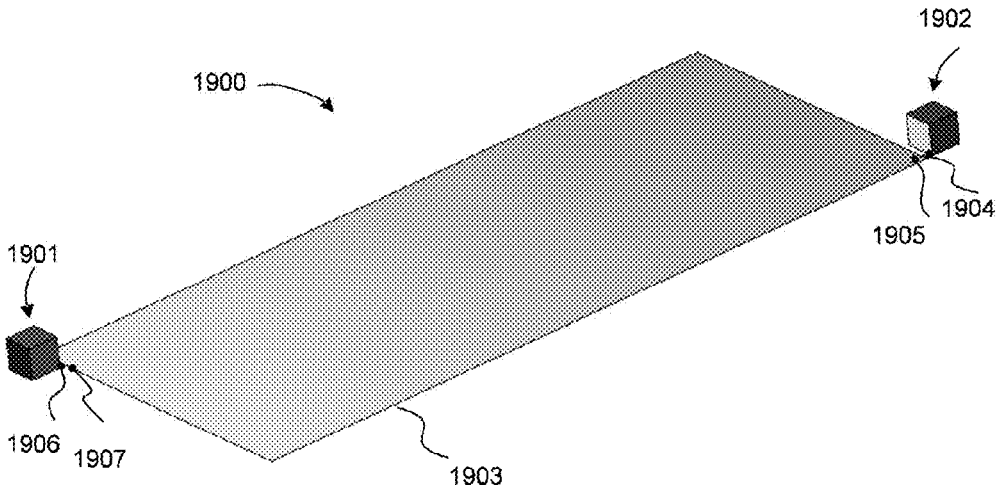

FIG. 19—Example of a radiating structure for a radiating system, the radiating structure including a first and a second radiation booster, each one comprising a conductive part and located at the opposite corners of a ground plane.

Figure 20:
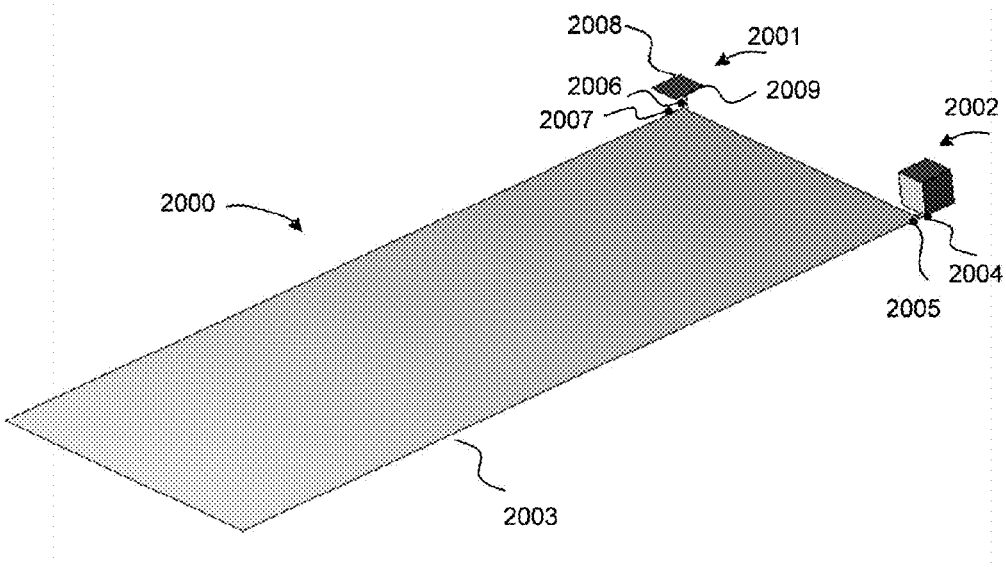

FIG. 20—Example of a radiating structure for a radiating system, the radiating structure including a first and a second radiation booster, each one comprising a conductive part. The orthogonal projection of the first radiation booster overlaps the ground plane while the orthogonal projection of the second radiation booster does not overlap the ground plane.

Figure 21:
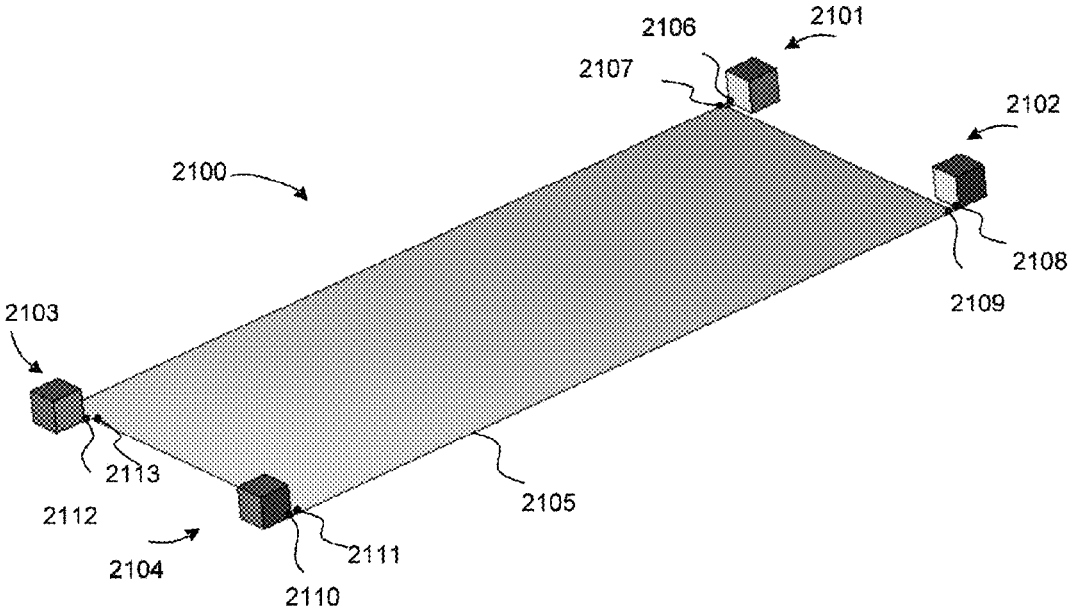

FIG. 21—Example of a radiating structure for a radiating system, the radiating structure including four radiation boosters, each one comprising a conductive part.

Figure 22:
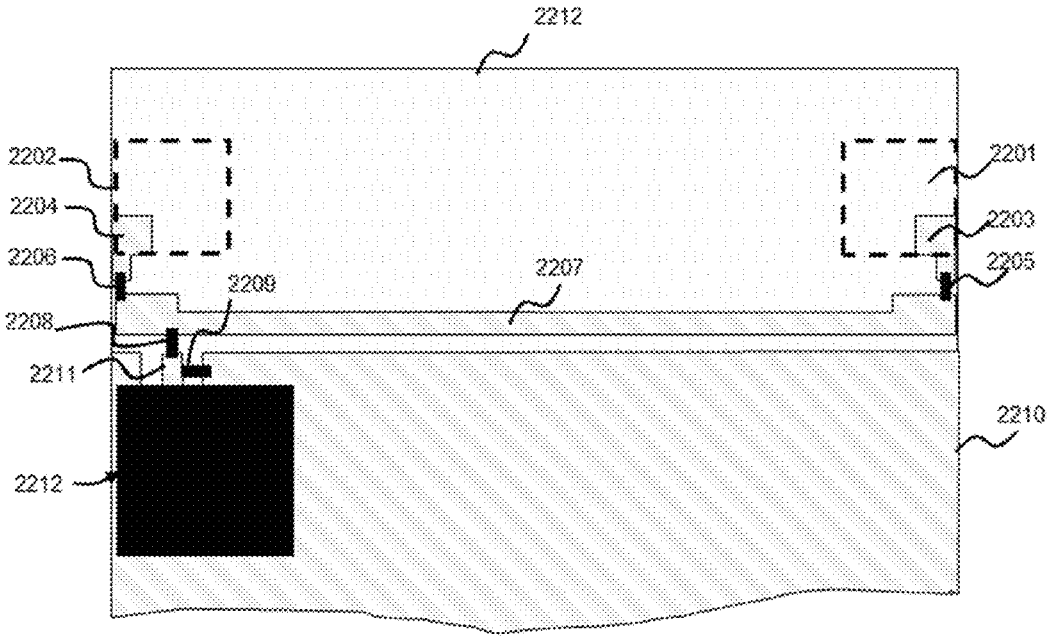

FIG. 22—Partial top plan view of a partially-populated PCB showing the layout of the ground plane layer of a radiating structure and the conducting traces and pads of a radiofrequency system.

Figure 23:
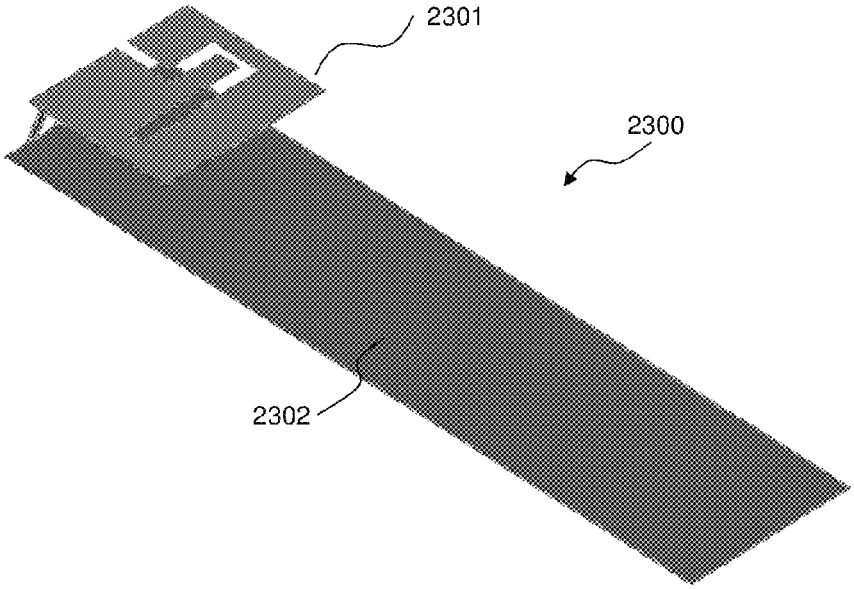
(PRIOR ART) Fig. 23

FIG. 23—Typical radiating structure of a wireless handheld or portable device.

Figure 24:
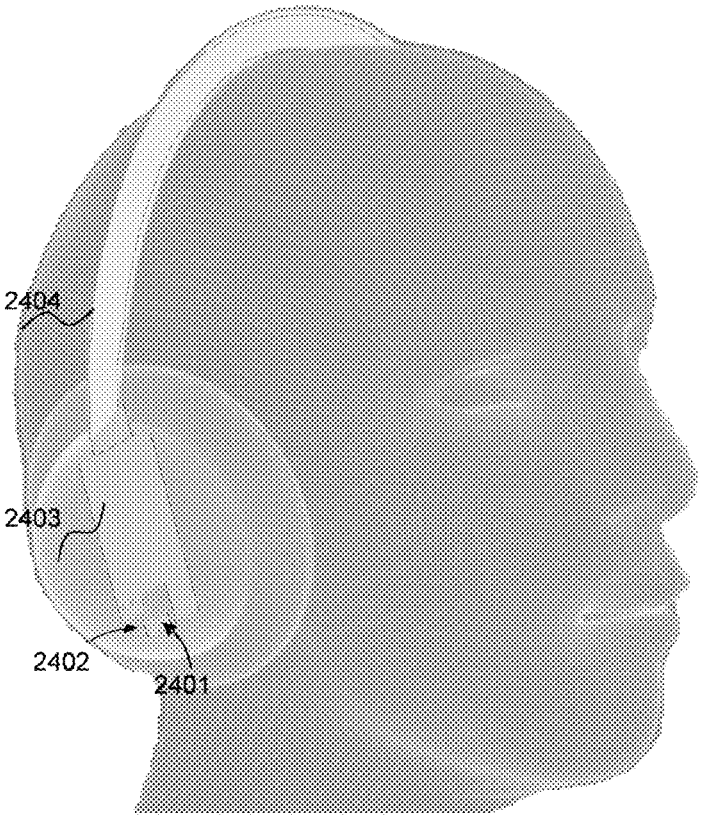

FIG. 24—Example of a radiating structure for a radiating system, the radiating structure including a first and a second radiation booster, each one comprising a conductive part integrated in a headset device.

Figure 25:
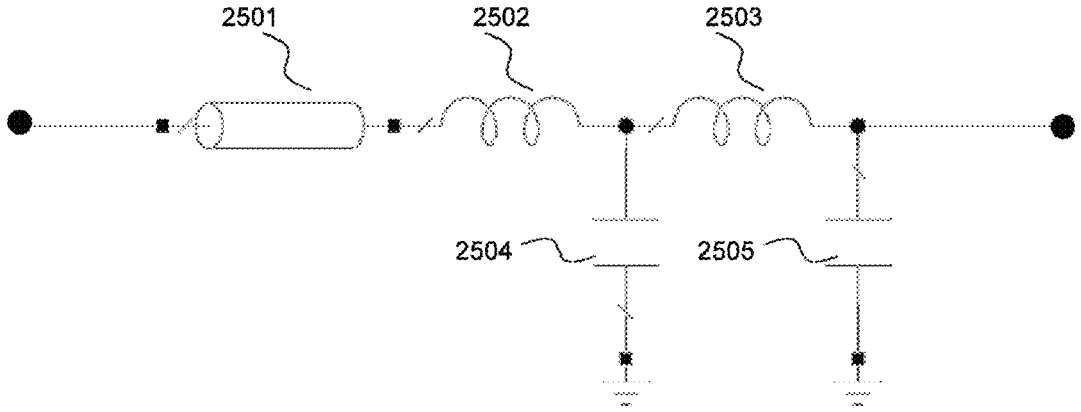

FIG. 25—Example of a delay element comprising a transmission line and lumped components (inductors and capacitors).

DETAILED DESCRIPTION

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

Figure 1A:
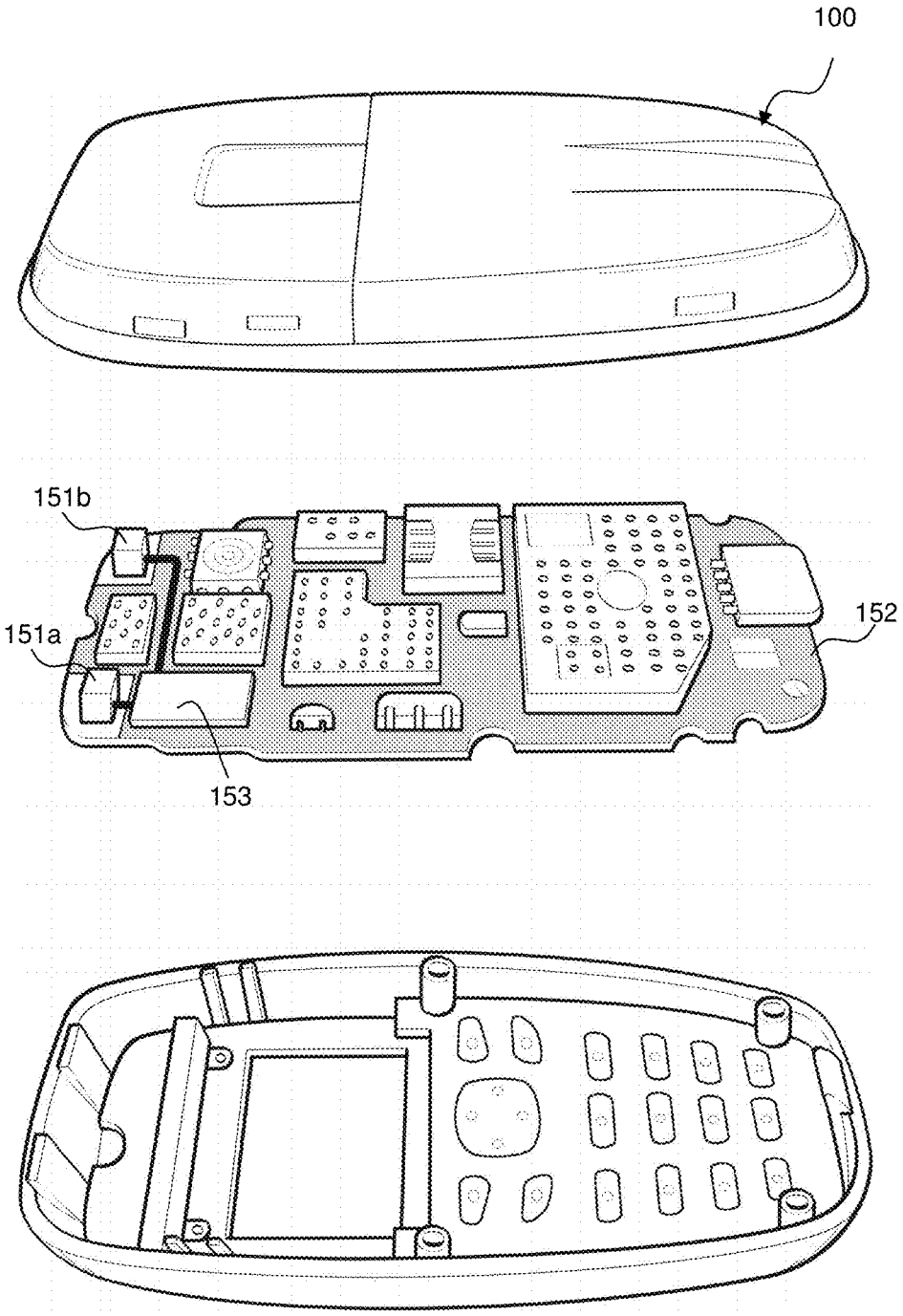
FIG. 1—(a) Example of a wireless handheld or portable device including a radiating system according to the present invention.

FIG. 1 shows an illustrative example of a wireless handheld or portable device 100 capable of multiband operation according to the present invention. In FIG. 1*a*, there is shown an exploded perspective view of the wireless handheld or portable device 100 comprising a radiating structure that includes a first radiation booster 151*a*, a second radiation booster 151*b* and a ground plane layer 152 (which could be included in a layer of a multilayer PCB). The wireless handheld or portable device 100 also comprises a radiofrequency system 153, which is interconnected with said radiating structure.

In FIG. 2, it is shown a schematic representation of three examples of radiating systems for a multiband wireless handheld or portable device according to the present invention.

Figure 2A:
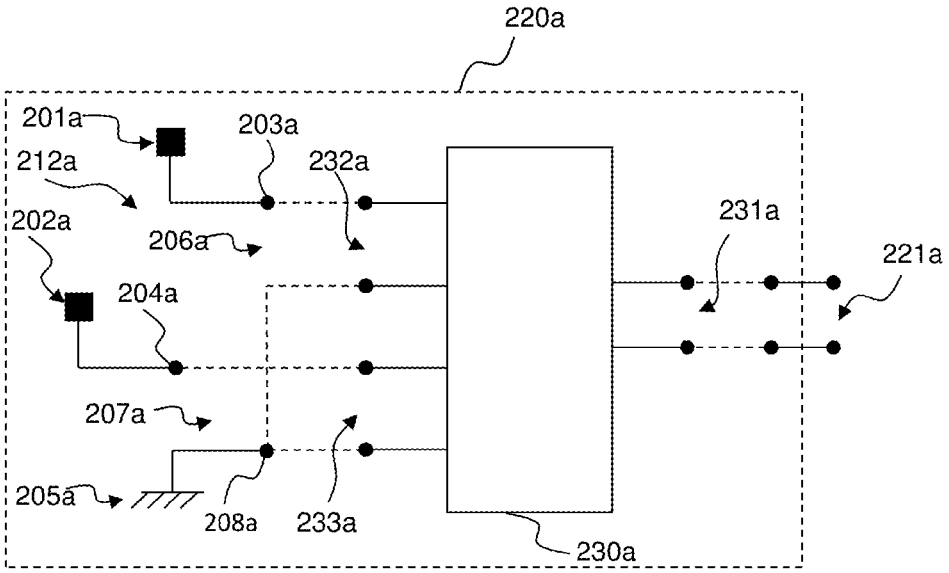
FIG. 2—Schematic representation of a radiating system according to the present invention: (a) The radiating system comprises radiation boosters; (b) the radiating system comprises radiating elements as well as radiation boosters. In this particular example the radiating system includes radiating element and a radiation booster; (c) the radiating system comprises radiating elements.

In particular, in FIG. 2*a* a radiating system 220*a* comprises a radiating structure 212*a*, a radiofrequency system 230*a*, and an external port 221*a*. The radiating structure 212*a* comprises a ground plane layer 205*a*, said ground plane layer including a connection point 208*a* and two radiation boosters: a first radiation booster 201*a*, which includes a connection point 203*a*, and a second radiation booster 202*a*, which includes a connection point 204*a*. The radiating structure 212*a* further comprises an internal port 206*a* defined between the connection point of the first radiation booster 203*a* and the connection point of the ground plane layer 208*a*; while a second internal port 207*a* is defined between a connection point of the second radiation booster 204*a* and the same connection point of the ground plane layer 208*a*. In this particular example, the internal ports are defined between the connection points of each one of the radiation boosters and the connection point of the ground plane layer. However, in a preferred embodiment two or more connection points of the ground plane layer can be used to define the internal ports of the radiating structure, that is a first internal port is preferably defined between a first connection point of a first radiation booster and a first connection point of the ground plane layer whereas the second internal port is preferably defined between a second connection point of a second radiation booster and a second connection point of the ground plane layer. Furthermore, the radiofrequency system 230*a* comprises three ports: a first port 232*a* is connected to the internal port of the radiating structure 206*a*, a second port 233*a* is connected to the internal port of the radiating structure 207*a*; and a third port 231*a* is connected to the external port of the radiating system 221*a*. That is, the radiofrequency system 230*a* comprises a port connected to each of the at least one internal ports of the radiating structure 212*a*, and a port connected to the external port of the radiating system 221*a*.

Figure 2B:
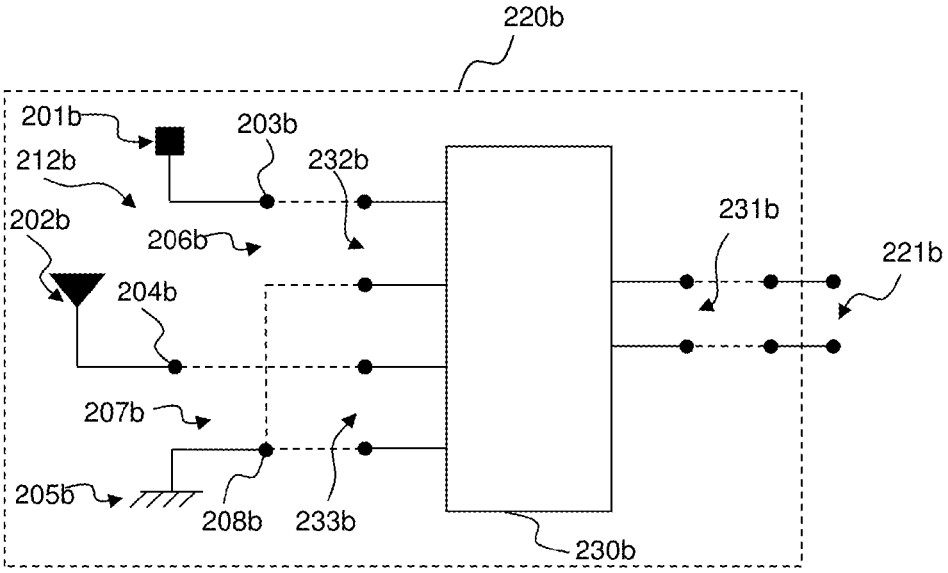

FIG. 2*b* depicts a further example of a radiating system 220*b* having a radiating structure 212*b* and a radiofrequency system 230*b*. The radiating structure comprises a radiation booster 201*b*, a radiating element 202*b*, and a ground plane layer 205*b*. In a similar manner as explained in the paragraph above, a first internal port 206*b* is defined between a connection point of the radiation booster 203*b* and a connection point of the ground plane layer 208*b*; while a second internal port 207*b* is defined between a connection point of the radiating element 204*b* and a connection point of the ground plane layer 208*b*. It is important to emphasize that just for the sake of simplicity a single connection point of the ground plane layer is depicted. However, according to the present invention the ground plane layer can present two or more connection points each one of them defining together with a connection point of a radiating element or radiation booster an internal port of the radiating structure. The first internal port 206*b* is connected to a first port of the radiofrequency system 232*b*, the second internal port is 207*b* is connected to a second port of the radiofrequency system 233*b*, and a third port of the radiofrequency system 231*b* is connected to the external port of the radiating system 221*b*.

Figure 2C:
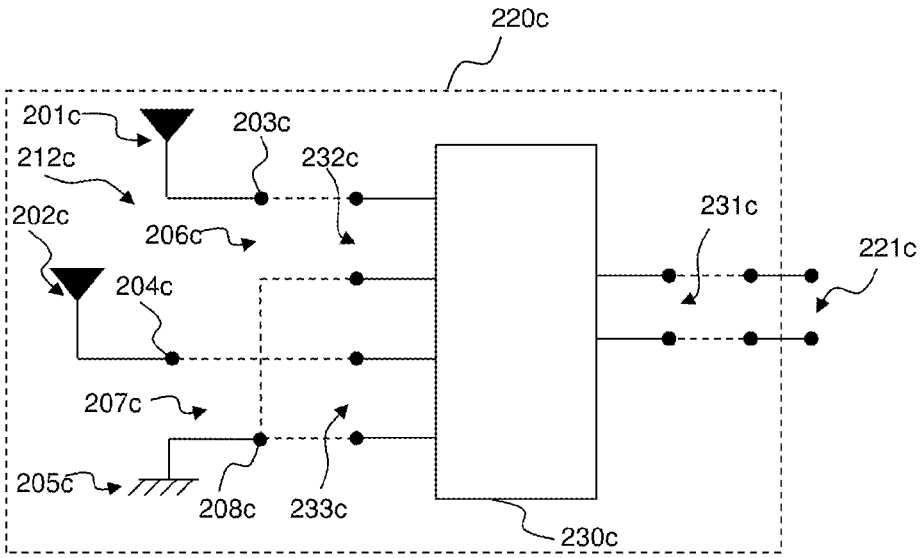

FIG. 2*c* depicts a further example of radiating system 220*c* according to the present invention. In this case, the radiating system 220*c* comprises a radiating structure 212*c* including two radiating elements, a first radiating element 201*c*, a second radiating element 202*c*, and a ground plane layer 205*c*. The radiating system further comprises a radiofrequency system 230*c* which is interconnected between the internal ports (206*c*, 207*c*) of the radiating structure 212*c* and the external port of the radiating system 221*c* in a similar manner as explained above in connection with FIGS. 2*a*-2*b*.

Figure 3A:
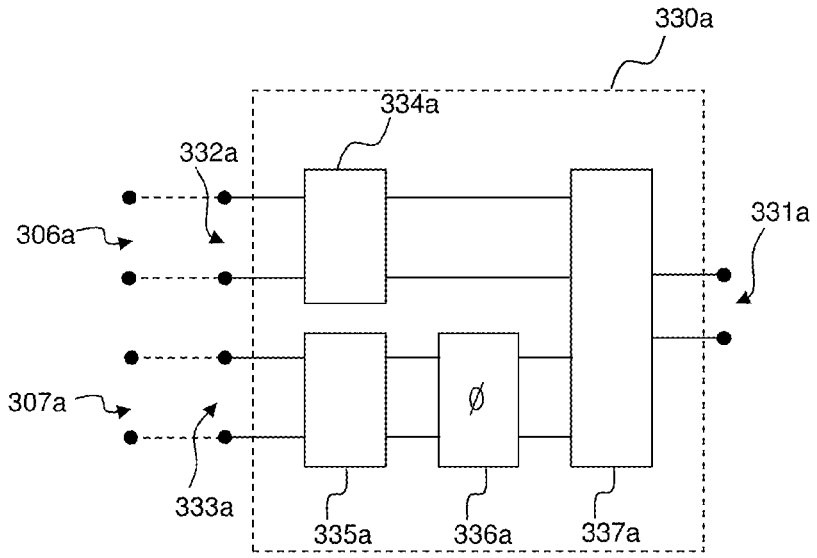
FIG. 3—Block diagram of three examples of radiofrequency systems used in a radiating system according to the present invention: (a) Radiofrequency system for a radiating structure including two radiation boosters; (b) Radiofrequency system for a radiating structure including at least one radiating element and at least one radiation booster; and (c) Radiofrequency system for a radiating structure including two radiating elements.
Figure 3B:
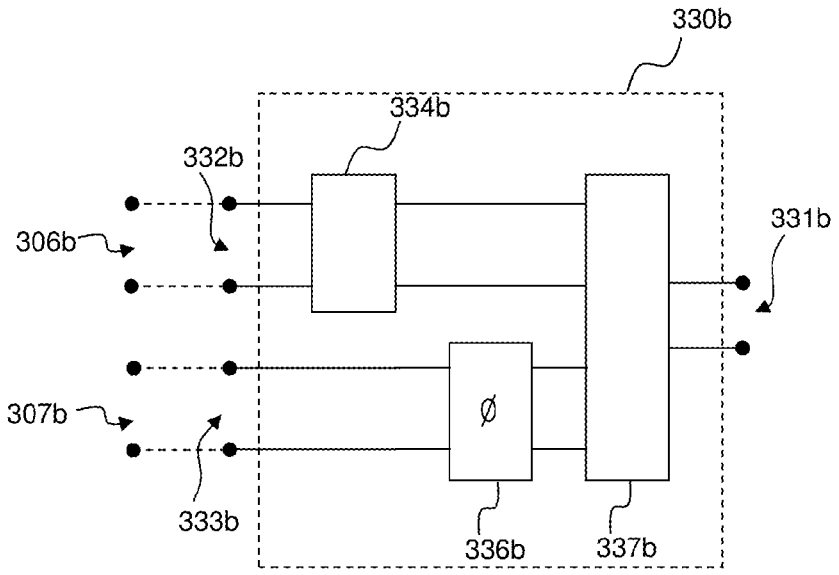
Figure 3C:
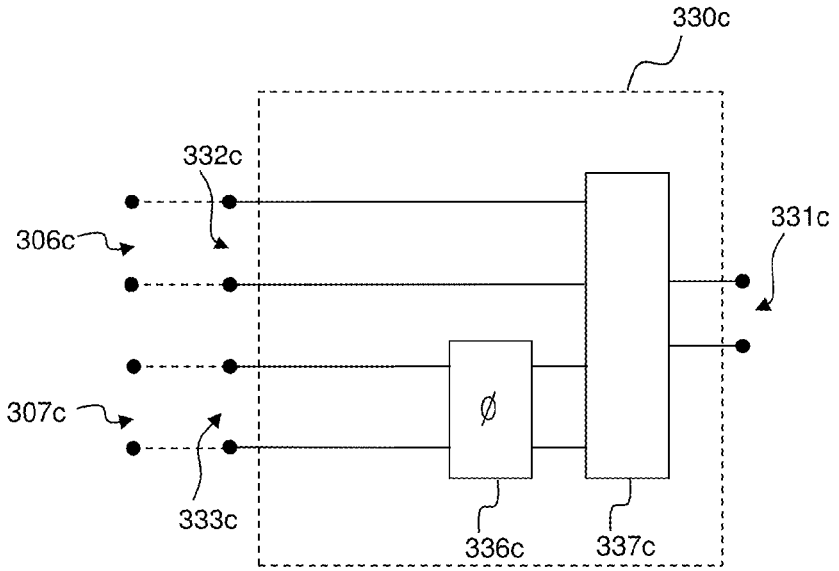

FIG. 3 shows the block diagram of three preferred examples of radiofrequency systems according to the present invention. The radiofrequency systems depicted in FIG. 3*a*-*c* are preferable for the radiating systems shown in FIG. 2*a*-*c*, respectively.

In FIG. 3*a* the radiofrequency system 330*a* comprises a first port 332*a* connected to a first internal port 306*a* and a second port 333*a* connected to a second internal port 307*a*. The radiofrequency system further comprises a third port 331*a* connected to an external port of a radiating system. The first port 332*a* is connected to a first reactance cancellation element 334*a*, whereas the second port is connected to a second reactance cancellation element 335*a* which is, at the same time, connected to a delay element 336*a*. The first reactance cancellation element is intended for providing resonance in a first frequency associated to a first frequency region of operation, whereas the second reactance cancellation element is selected for providing resonance in a second frequency allocated in a second frequency region of operation of the electromagnetic spectrum. In this particular example, the radiofrequency system 330*a* further comprises a fine tuning stage 337*a* interconnected between the first reactance cancellation 334*a*, the delay element 336*a* and a third port 331*a* connected to an external port of a radiating system.

In this case one end of the delay element 336*a* is connected to the second reactance cancellation element 335*a* while another end is connected to the fine tuning stage 337*a*. In other preferred examples, one end of the delay element 336*a* is connected to the first reactance cancellation element 334*a* while another end is connected to the fine tuning stage 337*a*.

Radiating structures composed by radiation boosters are preferable to minimize the required space into the wireless handheld device, thus allowing and simplifying the integration of other components while enabling multiple functionalities.

Referring now to FIG. 3*b*, the radiofrequency system 330*b* comprises a reactance cancellation element 334*b* connected to a first port 332*b* of the radiofrequency system. Said first port 332*b* is connected to a first internal port of a radiating structure comprising a radiation booster, such as the one depicted in FIG. 2*b*. Otherwise, a second port 333*b* of the radiofrequency system is directly connected to a delay element since, in this case the radiating structure (similar to that shown in FIG. 2*b*) comprises a radiating element, i.e. the internal port 307*b* is defined between a connection point of a radiating element and a connection point of the ground plane. A fine-tuning stage 337*b* is also added between the first reactance cancellation element 334*b*, the delay element 336*b*, and a third port 331*b* of the radiofrequency system 330*b* connected to an external port of a radiating system. Radiating structures combining radiating elements with radiation boosters are preferable for simplifying the complexity of the radiofrequency system. Radiofrequency systems with the least number of reactive components are preferred for minimizing radiation losses and tolerance effects.

In another preferred example, one end of the delay element 336*b* is connected to the first reactance cancellation element 334*b* while another end is connected to the fine tuning stage 337*b*. In this case the internal port 307*b* is directly connected to the fine tuning stage 337*b*. If a fine tuning stage is not required it would be directly connected to port 331*b*, which is at the same time connected to an external port of the radiofrequency system 330*b*, namely an input/output port.

FIG. 3*c* depicts a further example of a radiofrequency system according to the present invention. This radiofrequency system 330*c* is preferred for those cases in which the radiating structure is composed by radiating elements. In these cases, no reactance cancellation elements are needed and just a delay element 336*c* is inserted between a first port 332*c* and a second port 333*c*. A fine tuning stage 337*c* is further added to interconnect the first port 332*c* and the delay element 336*c* to a third port 331*c*.

In other preferred example, one end of the delay element 336*c* is connected to the internal port 306*c* while another end is connected to the fine tuning stage 337*c*. In this case the internal port 307*c* is directly connected to the fine tuning stage 337*c*. If a fine tuning stage is not required it would be directly connected to port 331*c*, which is at the same time connected to an external port of the radiofrequency system 330*c*, namely an input/output port.

In some cases, the fine tuning stage is not required since the delay element already produce compact impedance loops centered in a circle of VSWR≤4, preferably of VSWR≤3 of the Smith Chart.

FIG. 4 shows a preferred example of a radiating structure suitable for a radiating system operating in a first frequency region of the electromagnetic spectrum between 824 MHz and 960 MHz and in a second frequency region of the electromagnetic spectrum between 1710 MHz and 2690 MHz. In this sense, the radiating system operates at least two frequency bands each one associated to a particular communication standard, namely GSM850 and GSM900 in a first frequency region of the electromagnetic spectrum. In addition the radiating system operates five frequency bands allocated in a second frequency region of the electromagnetic spectrum containing the communication standards GSM1800, GSM1900, UMTS, LTE2100, LTE2300, and LTE2500.

The radiating structure 412 comprises a first radiation booster 401, a second radiation booster 402, and a ground plane layer 407. In FIG. 4*b*, there is shown in a top plan view the ground plane rectangle 450 associated to the ground plane layer 407. In this example, since the ground plane layer 407 has a substantially rectangular shape, its ground plane rectangle 450 is readily obtained as the rectangular perimeter of said ground plane layer 407.

The ground plane rectangle 450 has a long side of approximately 120 mm and a short side of approximately 50 mm. Therefore, in accordance with an aspect of the present invention, the ratio between the long side of the ground plane rectangle 450 and the free-space wavelength corresponding to the lowest frequency of the first frequency region (i.e., 824 MHz) is advantageously larger than 0.3. Moreover, said ratio is advantageously also smaller than 1.0.

In this example, the first radiation booster 401 and the second radiation booster 402 are of the same type, shape and size. However, in other examples the radiation boosters 401, 402 could be of different types, shapes and/or sizes. Thus, in FIG. 4 each of the first and the second radiation boosters 401, 402 includes a conductive part featuring a polyhedral shape comprising six faces. Moreover, in this case said six faces are substantially square having an edge length of approximately 5 mm, which means that said conductive part is a cube. In this case, the conductive part of each of the two radiation boosters 401, 402 is not connected to the ground plane layer 407. A first booster box 451 for the first radiation booster 401 coincides with the external area of said first radiation booster 401. Similarly, a second booster box 452 for the second radiation booster 402 coincides with the external area of said second radiation booster 402. In FIG. 4*b*, it is shown a top plan view of the radiating structure 412, in which the top face of the first booster box 451 and that of the second booster box 452 can be observed.

In accordance with an aspect of the present invention, a maximum size of the first radiation booster 401 (said maximum size being a largest edge of the first booster box 451) is advantageously smaller than 1/50 times the free-space wavelength corresponding to the lowest frequency of the first frequency region of operation of the radiating structure 412, and a maximum size of the second radiation booster 402 (said maximum size being a largest edge of the second booster box 452) is also advantageously smaller than 1/50 times said free-space wavelength. In particular, said maximum sizes of the first and second radiation boosters 401, 402 are also advantageously larger than 1/180 times said free-space wavelength.

Furthermore in this example, the first and second radiation boosters have each a maximum size smaller than 1/30 times the free-space wavelength corresponding to the lowest frequency of the second frequency region of operation of the radiating structure 412, but advantageously larger than 1/120 times said free-space wavelength.

In FIG. 4, the first and second radiation boosters 401, 402 are arranged with respect to the ground plane layer 407 so that the upper and bottom faces of the first radiation booster 401 and the upper and bottom faces of the second radiation booster 402 are substantially parallel to the ground plane layer 407. Moreover, the bottom face of the first radiation booster 401 is advantageously coplanar to the bottom face of the second radiation booster 402, and the bottom faces of both radiation boosters 401, 402 are also advantageously coplanar to the ground plane layer 407. With such an arrangement, the height of the radiation boosters 401, 402 with respect to the ground plane layer is not larger than 2% of the free-space wavelength corresponding to the lowest frequency of the first frequency region.

In the radiating structure 412, the first radiation booster 401 and the second radiation booster 402 protrude beyond the ground plane layer 407. That is, the radiation boosters 401, 402 are arranged with respect to the ground plane layer 407 in such a manner that there is no ground plane in the orthogonal projection of the radiation boosters 401, 402 onto the plane containing the ground plane layer 407. The first radiation booster 401 is located substantially close to a first corner of the ground plane layer 407, while the second radiation booster 402 is located substantially close to a second corner of said ground plane layer 407. In particular, said first and second corners are at opposite ends of a short edge of the substantially rectangular ground plane layer 407.

The first radiation booster 401 comprises a connection point 403 located on the lower right corner of the bottom face of the first radiation booster 401. In turn, the ground plane layer 407 also comprises a first connection point 404 substantially on the upper right corner of the ground plane layer 407. A first internal port of the radiating structure 412 is defined between said connection point 403 and said first connection point 404.

Similarly, the second radiation booster 402 comprises a connection point 405 located on the lower left corner of the bottom face of the second radiation booster 402, and the ground plane layer 407 also comprises a second connection point 406 substantially on the upper left corner of the ground plane layer 407. A second internal port of the radiating structure 412 is defined between said connection point 405 and said second connection point 406.

In an alternative example, the ground plane layer 407 of the radiating structure 412 may comprise only the first connection point 404 (i.e., only one connection point). In that case the second internal port could have been defined between the connection point 405 of the second radiation booster 402 and said first connection point 404.

The very small dimensions of the first and second radiation boosters 401, 402 result in said radiating structure 412 having at each of the first and second internal ports a first resonant frequency at a frequency much higher than the frequencies of the first frequency region. In this case, the ratio between the first resonant frequency of the radiating structure 412 measured at each of the first and second internal ports (in absence of a radiofrequency system connected to them) and the highest frequency of the first frequency region is advantageously larger than 4.2.

Furthermore, the first resonance frequency at each of the first and second internal ports of the radiating structure 412 is also at a frequency much higher than the frequencies of the second frequency region.

Figure 6A:
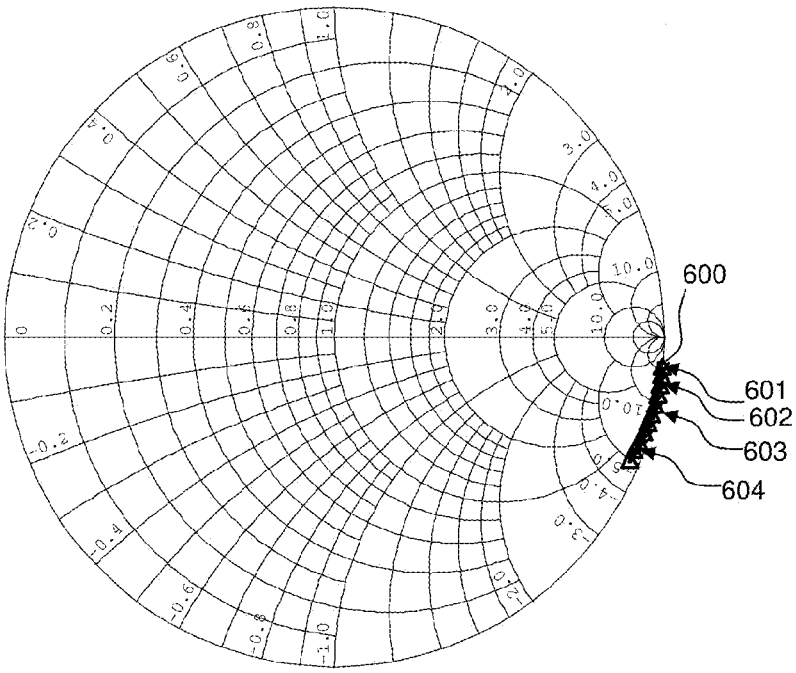
FIG. 6—Typical impedance transformation caused by the radiofrequency system depicted in FIG. 5 on the input impedance of the radiating structure of FIG. 4: (a) Input impedance at the first internal port and the second internal port when disconnected from the radiofrequency system; (b)

With such small dimensions of the first and second radiation boosters 401, 402, the input impedance of the radiating structure 412 measured at each of the first and second internal ports features an important reactive component, and in particular a capacitive component, within the frequencies of the first and second frequency regions, as it can be observed in FIG. 6*a*.

In FIG. 6*a*, curve 600 represents on a Smith chart the typical complex impedance at the first internal port of the radiating structure 412 as a function of the frequency when no radiofrequency system is connected to said first internal port. In particular, point 601 corresponds to the input impedance at the lowest frequency of the first frequency region, and point 602 corresponds to the input impedance at the highest frequency of the first frequency region. Similarly, point 603 corresponds to the input impedance at the lowest frequency of the second frequency region, and point 604 corresponds to the input impedance at the highest frequency of the second frequency region. The impedance curves associated to the first internal port and the second internal port are substantially similar. For this reason and for the sake of simplicity, just the impedance curve measured at the first internal port is illustrated in FIG. 6*a*.

Curve 600 is located on the lower half of the Smith chart, which indeed indicates that the input impedance at the first internal port and at the second internal port has a capacitive component (i.e., the imaginary part of the input impedance has a negative value) for at least all frequencies of the first and second frequency regions of operation (i.e., between point 601-602 and between points 603-604).

FIG. 5 presents a schematic of a radiofrequency system to be connected to the two internal ports of the radiating structure 412 in order to transform the input impedance of the radiating structure 412 and provide impedance matching in the first and second regions of operation of the radiating system.

The radiofrequency system comprises two ports 532, 533 to be connected respectively to the first (506) and second internal ports (507) of the radiating structure 412, and a third port to be connected to an external port of the radiating system 531.

The radiofrequency system also comprises a first reactance cancellation element 534 connected to port 532, providing resonance in a frequency allocated in a first frequency region of operation; and a second reactance cancellation element 535 connected to port 533, providing resonance in a frequency within the second frequency region.

The radiofrequency system further comprises a delay element 536 interconnecting the first reactance cancellation element 534 and the second reactance cancellation element 535 in order to combine both input impedances into a single port. The radiofrequency system further comprises a fine tuning stage 537 connected, after the first reactance cancellation element and the delay element, to an external port of the radiating system 531 as illustrated in FIG. 5. The delay element produce a difference in phase between a first input impedance measured after the first reactance cancellation element 534 and a second input impedance measured after the delay element once the second reactance cancellation 535 element is connected to port 533. Said difference in phase enables the apparition of impedance loops at the first and second frequency regions. The fine tuning stage comprises and L-shaped matching network formed by a series capacitor and a parallel inductor. Said fine tuning stage 537 places the impedance loops at the center of the Smith chart inscribed in a circle of VSWR≤3. The delay element comprises a transmission line featuring a characteristic impedance of 50 ohms and a length of approximately a quarter of a wavelength at the lowest frequency of the first frequency region, which corresponds to a phase of approximately 90° at the lowest frequency of the first frequency region.

FIG. 6 represent in a Smith chart the complex impedance values measured at different stages of the aforementioned radiofrequency system.

In this sense curve 600 of FIG. 6*a* corresponds to the complex input impedance measured at each one of the internal ports 506 and 507 of the radiating structure 412 when the other components of the radiofrequency system are disconnected. As it is observed the input impedance measured at the first internal port 506 as well as the input impedance measured at the second internal port 507 are substantially equivalents for this case. However, according to the present invention said input impedance could be different if different radiation boosters are used to excite the ground plane radiation mode. In this case, since both radiation boosters are equal (see FIG. 4) their input impedances measured at their corresponding internal ports are substantially equivalent. Said input impedance presents an important reactive behavior for both frequency regions of operation. In particular, point 601 corresponds to the input impedance at the lowest frequency of the first frequency region, and point 602 corresponds to the input impedance at the highest frequency of the first frequency region. Similarly, point 603 corresponds to the input impedance at the lowest frequency of the second frequency region, and point 604 corresponds to the input impedance at the highest frequency of the second frequency region. As it is depicted the complex input impedance presents a significant capacitive behavior for the first frequency region of operation 601-602 as well as for the second frequency region of operation 603-604.

Figure 6B:
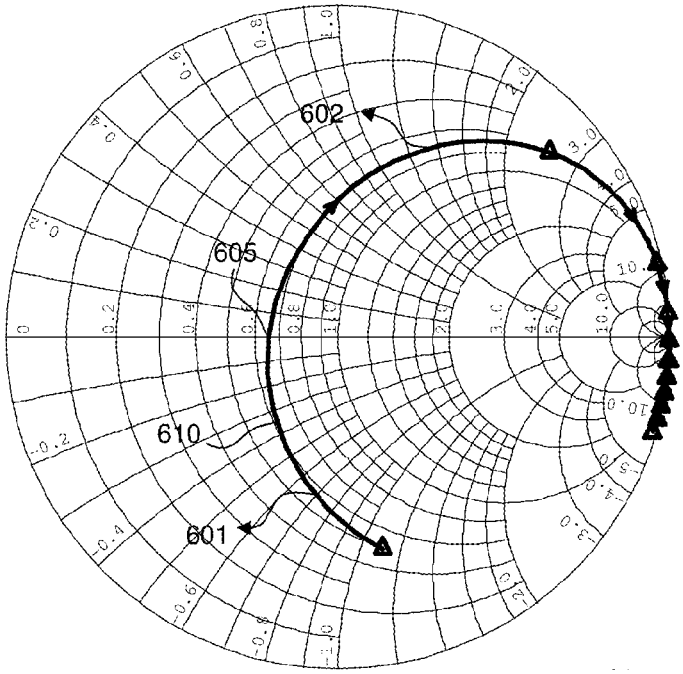

FIG. 6*b* depicts the complex input impedance 610 measured after the addition of a first reactance cancellation element 534 to the port 532 of the radiofrequency system connected to the first internal 506 port of the radiating structure 412 when no other elements of the radiofrequency system are connected. Such a reactance cancellation effect can be observed in FIG. 6*b*, in which the input impedance at the first internal port 506 of the radiating structure 412 (curve 600 in FIG. 6*a*) is transformed by the first reactance cancellation element 534 into an impedance having an imaginary part substantially close to zero in the first frequency region (see FIG. 6*b*). Curve 610 in FIG. 6*b* corresponds to the input impedance measured after the addition of the first reactance cancellation element 534. Said curve 610 crosses the horizontal axis of the Smith Chart at a point 605 located between point 601 and point 602, which means that the input impedance has an imaginary part equal to zero for a frequency advantageously between the lowest and highest frequencies of the first frequency region.

Figure 6C:
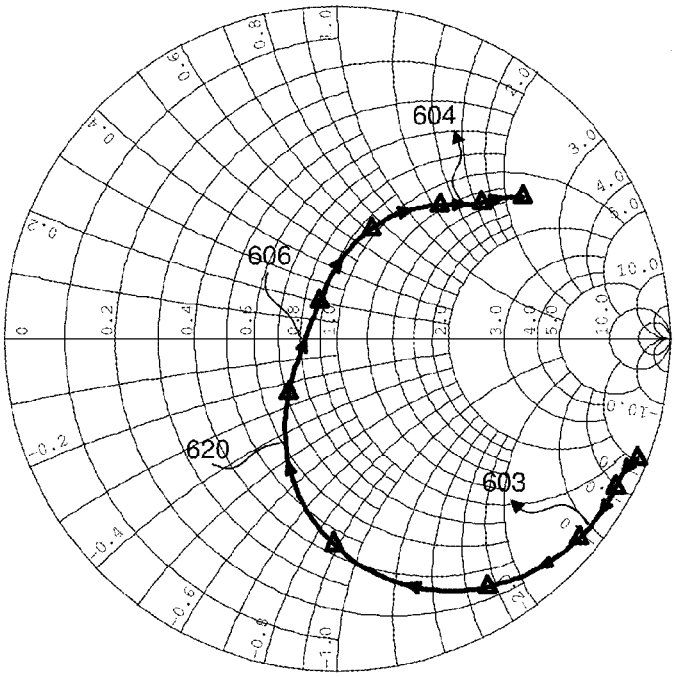
Figure 6D:
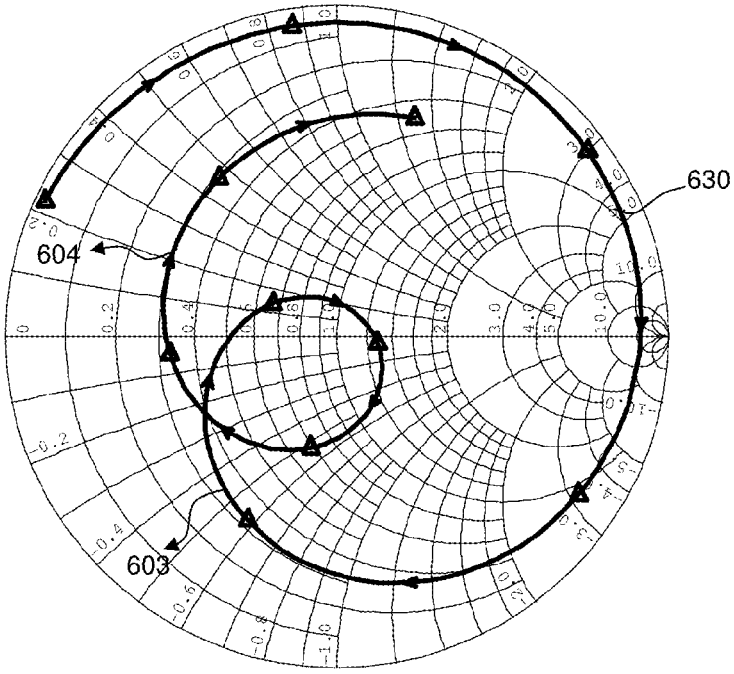

FIG. 6*c* depicts the complex input impedance 620 measured after the addition of a second reactance cancellation element 535 to the port 533 of the radiofrequency system connected to the second internal 507 port of the radiating structure 412 when no other elements of the radiofrequency system are connected. The effect of the second reactance cancellation element 535 on the input impedance at the second internal port 507 of the radiating structure 412 is shown in FIG. 6*c*, in which the input impedance at said second internal port (curve 620 in FIG. 6*c*) is transformed into an impedance having an imaginary part substantially close to zero in the second frequency region. Curve 620 in FIG. 6*c* corresponds to the input impedance measured after the addition of the second reactance cancellation element 535. Said curve 620 crosses the horizontal axis of the Smith Chart at a point 606 located between point 603 and point 604, which means that the input impedance has an imaginary part equal to zero for a frequency advantageously between the lowest and highest frequencies of the second frequency region.

A delay element 536 is added between the first reactance cancellation element 534 and the second reactance cancellation element 535 (see FIG. 5). The complex input impedance 630 depicted in FIG. 6*d* corresponds to the complex input impedance measured after the addition of said delay element, i.e. the other elements of the radiofrequency system are disconnected and just the reactance cancellation element 535 and the delay element 536 are connected to the internal port 507 through port 533 of the radiofrequency system. In this case the delay element comprises a transmission line featuring a characteristic input impedance of 50 ohms and a length of approximately a quarter of a wavelength at the lowest frequency of the first frequency region of operation. The wavelength takes into account the effective dielectric constant of the delay element.

Figure 6E:
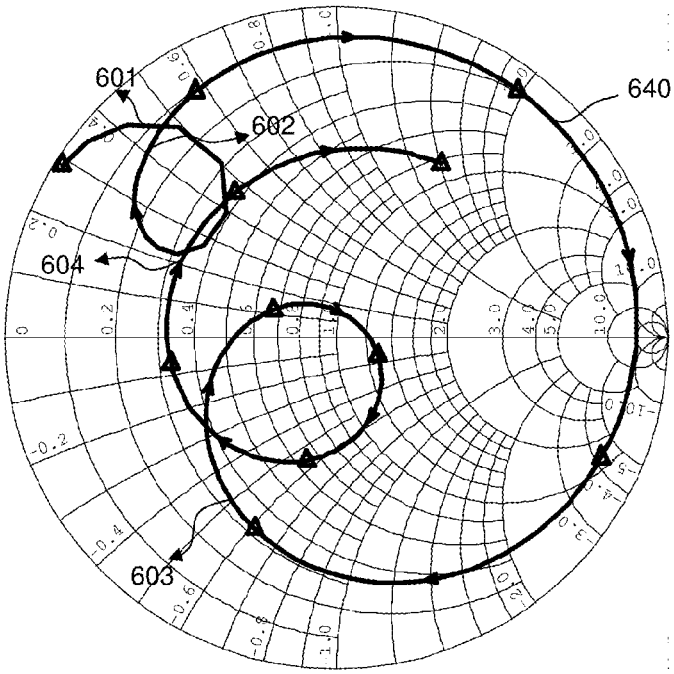

FIG. 6*e* depicts the complex input impedance 640 attained after the interconnection of the first reactance cancellation element 534 with the delay element 536 into a single port. As shown, the interconnection of the delay element between the first and the second reactance cancellation element 534, 535 produce two compact impedance loops, one associated to the first frequency region of operation (601, 602) and the other corresponding to the second frequency region of operation (603, 604). In some cases, said compact impedance loops are already inscribed inside a circle of a VSWR according to the specifications, such as for instance to a VSWR≤4, and preferably to a VSWR≤3 referred to a reference impedance of 50 Ohms. In some other cases, a fine tuning stage is added to center the compact impedance loops.

Figure 6F:
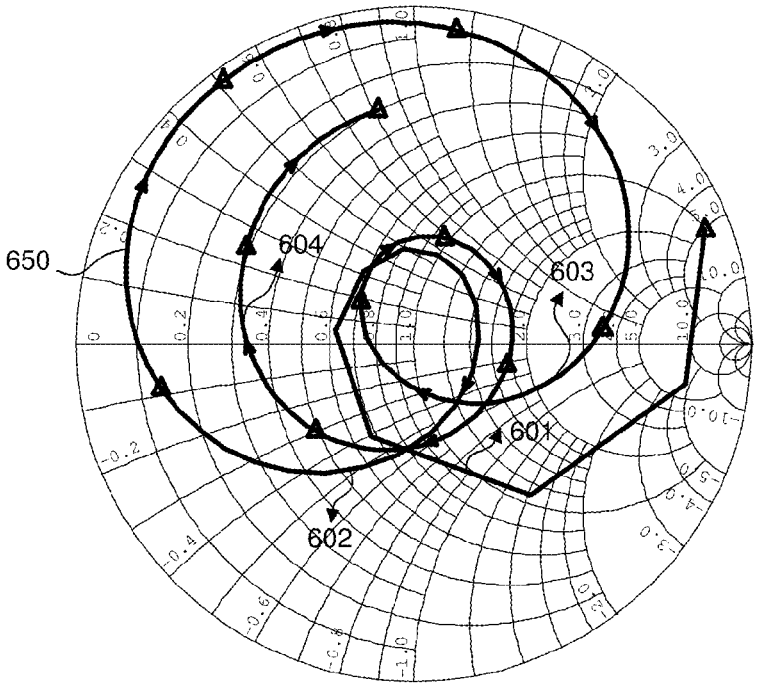

FIG. 6*f* depicts the complex input impedance 650 measured at the external port of the radiating system 531 after the addition of a fine tuning stage 537.

Finally, the frequency response of the radiating system resulting from the interconnection of the radiofrequency system of FIG. 5 to the radiating structure of FIG. 4 is shown in FIG. 7, in which the curve 700 corresponds to the reflection coefficient observed at the external port of the radiating system. The reflection coefficient 700 exhibits a reflection coefficient better than −6 dB in the first frequency region (delimited by points 601 and 602 on said curve 700) and in the second frequency region (delimited by points 603 and 604), making it possible for the radiating system to provide operability for the GSM850, GSM900, GSM1800, GSM1900, LTE2100, UMTS, LTE2300, LTE2500 standards, or in other words in a first frequency region ranging from 824-960 MHz and in a second frequency region ranging from 1710-2690 MHz. In this sense, the radiating system operates at least two frequency bands allocated in a first frequency region of the electromagnetic spectrum and at least five frequency bands allocated in a second frequency region of the electromagnetic spectrum.

The radiation patterns associated to the proposed radiating systems are mainly determined by the ground plane modes. In this sense, for this particular example they present an omni-directional character at both frequency regions of operation.

FIG. 9 shows a preferred example of a radiating structure suitable for a radiating system operating in a first frequency region of the electromagnetic spectrum between 824 MHz and 960 MHz and in a second frequency region of the electromagnetic spectrum between 1710 MHz and 2170 MHz. In this sense, the radiating system operates at least two frequency bands each one associated to a particular communication standard, namely GSM850 and GSM900 in a first frequency region of the electromagnetic spectrum. In addition the radiating system operates three frequency bands allocated in a second frequency region of the electromagnetic spectrum containing the communication standards GSM1800, GSM1900, UMTS, and LTE2100.

The radiating structure 912 comprises a first radiating element 901, a second radiating element 902, and a ground plane layer 905. In FIG. 9*b*, there is shown in a top plan view the ground plane rectangle 950 associated to the ground plane layer 905. In this example, since the ground plane layer 905 has a substantially rectangular shape, its ground plane rectangle 950 is readily obtained as the rectangular perimeter of said ground plane layer 905.

The ground plane rectangle 950 has a long side of approximately 90 mm and a short side of approximately 40 mm. Therefore, in accordance with an aspect of the present invention, the ratio between the long side of the ground plane rectangle 450 and the free-space wavelength corresponding to the lowest frequency of the first frequency region (i.e., 824 MHz) is advantageously larger than 0.2. Moreover, said ratio is advantageously also smaller than 1.0.

In this example, the first radiating element 901 and the second radiating element 902 are different and they are tuned to a different resonant frequency. In this case, the conductive part of each of the two radiating elements 901, 902 is not connected to the ground plane layer 905. A first radiating box 951 for the first radiating element 901 coincides with the external area of said first radiating element 901. Similarly, a second radiating box 952 for the second radiating element 902 coincides with the external area of said second radiating element 902. In FIG. 9*b*, it is shown a top plan view of the radiating structure 912, in which the top face of the first radiating box 951 and that of the second radiating box 952 can be observed. The largest dimension of the first radiating box 951 and the second radiating box 952 is around 10 mm.

In accordance with an aspect of the present invention, a maximum size of the first radiating element 901 (said maximum size being a largest edge of the first radiating box 451) is advantageously smaller than 1/25 times the free-space wavelength corresponding to the lowest frequency of the first frequency region of operation of the radiating structure 912, and a maximum size of the second radiating element 902 (said maximum size being a largest edge of the second radiating box 952) is also advantageously smaller than 1/25 times said free-space wavelength. In particular, said maximum sizes of the first and second radiating elements 901, 902 are also advantageously larger than 1/45 times said free-space wavelength.

Furthermore in this example, the first and second radiating elements have each a maximum size smaller than 1/10 times the free-space wavelength corresponding to the lowest frequency of the second frequency region of operation of the radiating structure 912, but advantageously larger than 1/30 times said free-space wavelength.

In FIG. 9, the first and second radiating elements 901, 902 are arranged with respect to the ground plane layer 905 so that the upper and bottom faces of the first radiating element 901 and the upper and bottom faces of the second radiating element 902 are substantially parallel to the ground plane layer 905. In particular, they are also advantageously coplanar to the ground plane layer 905. With such an arrangement, the height of the radiating elements 901, 902 with respect to the ground plane layer is not larger than 1% of the free-space wavelength corresponding to the lowest frequency of the first frequency region.

In the radiating structure 912, the first radiating element 901 and the second radiating element 902 protrude beyond the ground plane layer 905. That is, the radiating elements 901, 902 are arranged with respect to the ground plane layer 905 in such a manner that there is no ground plane in the orthogonal projection of the radiating elements 901, 902 onto the plane containing the ground plane layer 905. The first radiating element 901 is located substantially close to a first corner of the ground plane layer 905, while the second radiating element 902 is located substantially close to a second corner of said ground plane layer 905. In particular, said first and second corners are at opposite ends of a short edge of the substantially rectangular ground plane layer 905.

The first radiating element 901 comprises a connection point 903 located on the lower left corner of the bottom face of the first radiating element 901. In turn, the ground plane layer 905 also comprises a first connection point 904 substantially on the upper left corner of the ground plane layer 905. A first internal port of the radiating structure 912 is defined between said connection point 903 and said first connection point 904.

Similarly, the second radiating element 902 comprises a connection point 906 located on the lower right corner of the bottom face of the second radiating element 902, and the ground plane layer 905 also comprises a second connection point 907 substantially on the upper right corner of the ground plane layer 905. A second internal port of the radiating structure 912 is defined between said connection point 906 and said second connection point 907.

The first radiating element provides a resonant frequency allocated in a first frequency region of operation while the second radiating element resonates in a frequency within the second frequency region of operation of the radiating system.

Figure 11A:
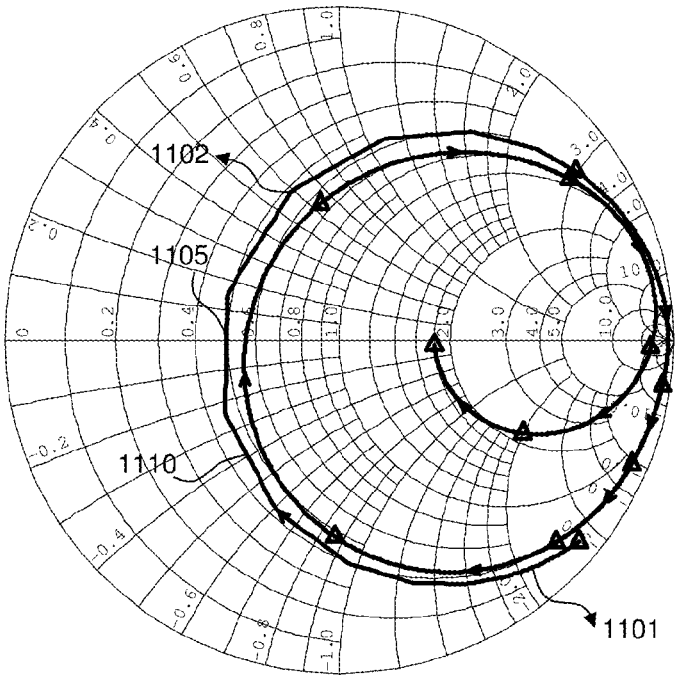

In FIG. 11*a*, curve 1110 represents on a Smith chart the typical complex impedance at the first internal port of the radiating structure 912 as a function of the frequency when no radiofrequency system is connected to said first internal port. In particular, point 1101 corresponds to the input impedance at the lowest frequency of the first frequency region, and point 1102 corresponds to the input impedance at the highest frequency of the first frequency region. At the same time, point 1105 corresponds to the resonant frequency measured at the internal port of the first radiating element 901 when the radiofrequency system is disconnected. Similarly, in FIG. 11*b* curve 1120 represents on a Smith chart the typical complex impedance at the first internal port of the radiating structure 912 as a function of the frequency when no radiofrequency system is connected to said second internal port. In particular, point 1103 corresponds to the input impedance at the lowest frequency of the second frequency region, and point 1104 corresponds to the input impedance at the highest frequency of the second frequency region. At the same time, point 1106 corresponds to the resonant frequency measured at the internal port of the second radiating element 902 when the radiofrequency system is disconnected.

FIG. 10 presents a schematic of a radiofrequency system to be connected to the two internal ports of the radiating structure 912 in order to transform the input impedance of the radiating structure 912 and provide impedance matching in the first and second regions of operation of the radiating system.

The radiofrequency system comprises two ports 1032, 1033 to be connected respectively to the first (1006) and second internal ports (1007) of the radiating structure 912, and a third port to be connected to a single external port of the radiating system 1031.

The radiofrequency system further comprises a delay element 1036 interconnecting the first port 1032 and the second port 1033 in order to combine both input impedances into a single port. The radiofrequency system further comprises a fine tuning stage 1037 interconnected between ports 1032 and 1031. The delay element produce a difference in phase between a first input impedance measured in the first internal port 1006 and the second input impedance measured in the second internal port 1007. Said difference in phase enables the apparition of impedance loops at the first and second frequency regions of operation. The fine tuning stage comprises and L-shaped matching network formed by a series capacitor and a parallel inductor. Said fine tuning stage 1037 places the impedance loops at the center of the Smith chart inscribed in a circle of VSWR≤3. The delay element comprises a transmission line featuring a characteristic impedance of 100 ohms and a length of approximately a quarter of a wavelength at the lowest frequency of the first frequency region, which corresponds to a phase of approximately 80° at the lowest frequency of the first frequency region.

FIG. 11 represent in a Smith chart the complex impedance values measured at different stages of the aforementioned radiofrequency system.

In this sense curve 1110 of FIG. 11*a* corresponds to the complex input impedance measured at the first internal port 1006 of the radiating structure 1012 when the other components of the radiofrequency system are disconnected. As it is observed the input impedance measured at the first internal port 1006 presents a resonant frequency 1105 within the lowest frequency 1101 and the highest frequency 1102 of the first frequency region of operation.

Figure 11B:
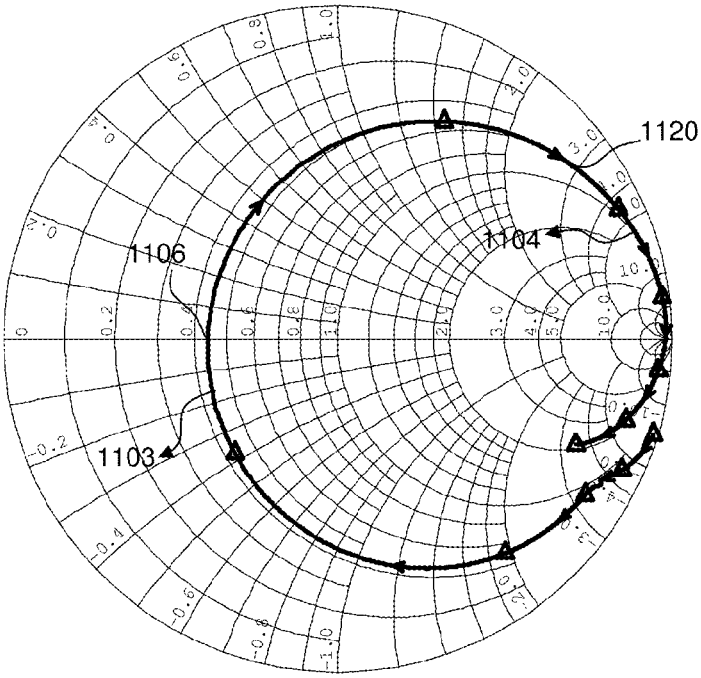

FIG. 11*b* depicts the complex input impedance 1120 measured at the second internal port 1007 of the radiating structure 1012 when the other components of the radiofrequency system are disconnected.

Figure 11C:
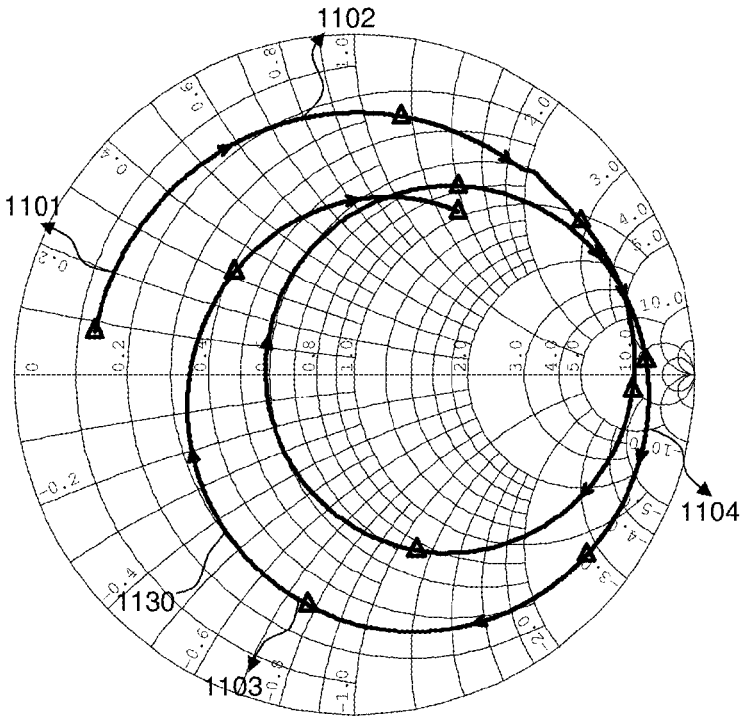

FIG. 11*c* depicts the complex input impedance 1130 measured after the interconnection of a delay element 1036 to the second port 1033 of the radiofrequency system when the other elements of the radiofrequency system are disconnected. In this case the delay element comprises a transmission line featuring a characteristic input impedance of 100 ohms and a length of approximately a quarter of a wavelength of the lowest frequency of the first frequency region of operation. The wavelength takes into account the effective dielectric constant of the delay element.

Figure 11D:
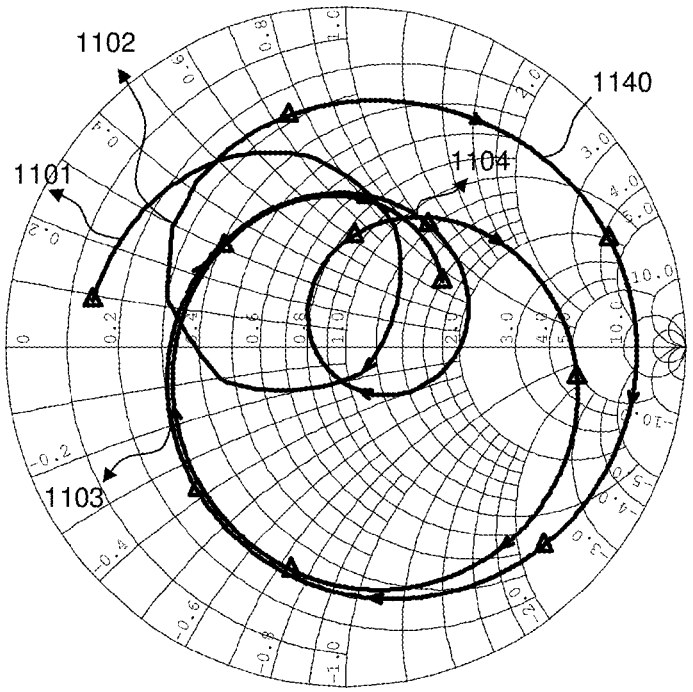

FIG. 11*d* depicts the complex input impedance 1140 attained after the interconnection of the delay element 1036 between the first port 1032 and the second port 1033. As shown, the interconnection of the delay element between the first and the second port of the radiofrequency system produce two compact impedance loops, one associated to the first frequency region of operation (1101, 1102) and the other corresponding to the second frequency region (1103, 1104) of operation. In some cases, said compact impedance loops are already inscribed inside a circle of a VSWR according to the specifications, such as for instance to a VSWR≤4, and preferably to a VSWR≤3 referred to a reference impedance of 50 Ohms. In some other cases, a fine tuning stage is added to center the compact impedance loops.

Figure 11E:
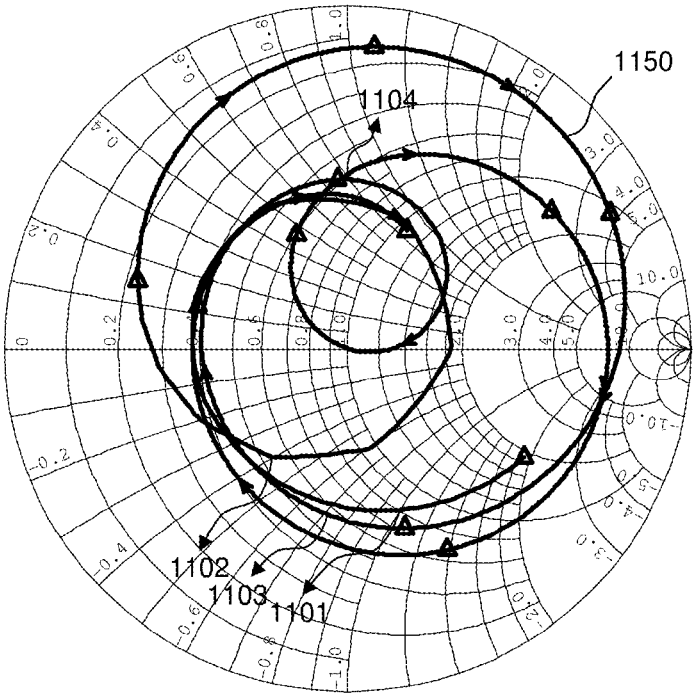

FIG. 11*e* depicts the complex input impedance 1150 measured at the external port of the radiating system 1131 after the addition of a fine tuning stage 1037.

Figure 11F:
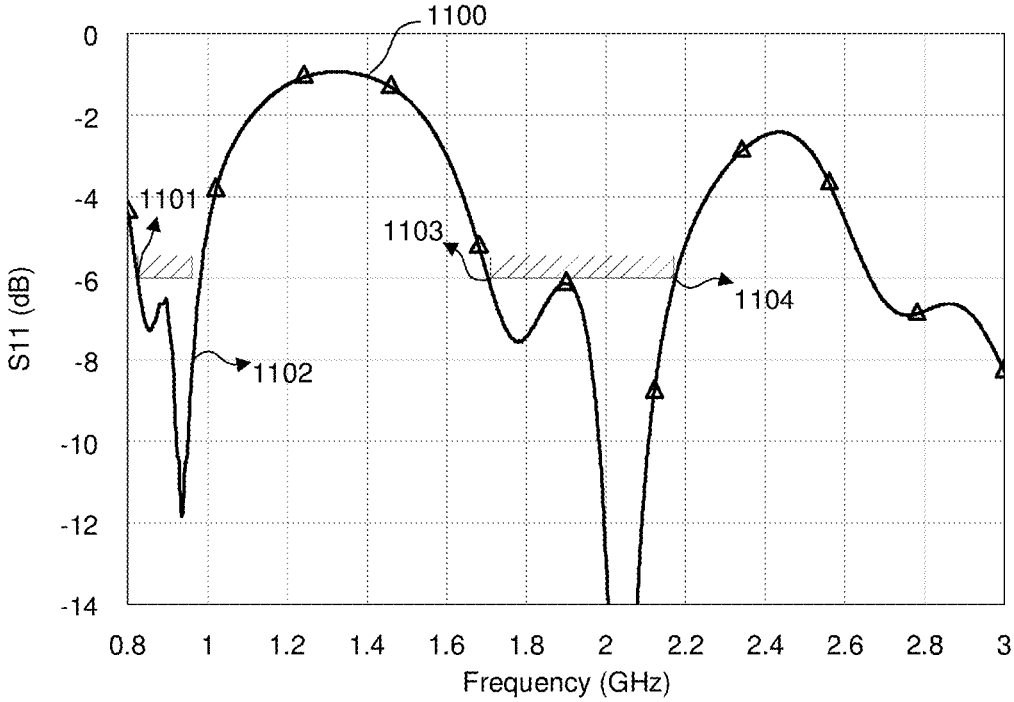

Finally, the frequency response of the radiating system resulting from the interconnection of the radiating system of FIG. 10 to the radiating structure of FIG. 9 is shown in FIG. 11*f*, in which the curve 1100 corresponds to the reflection coefficient observed at the external port of the radiating system. The reflection coefficient curve 1100 exhibits a reflection coefficient better than −6 dB in the first frequency region (delimited by points 1101 and 1102 on said curve 1200) and in the second frequency region (delimited by points 1103 and 1104), making it possible for the radiating system to provide operability for the GSM850, GSM900, GSM1800, GSM1900, LTE2100, and UMTS or in other words, in a first frequency region ranging from 824-960 MHz and in a second frequency region ranging from 1710-2170 MHz. In this sense, the radiating system operates at least two frequency bands allocated in a first frequency region of the electromagnetic spectrum and at least three frequency bands allocated in a second frequency region of the electromagnetic spectrum.

The radiation patterns associated to the proposed radiating systems are mainly determined by the ground plane modes. In this sense, for this particular example they present an omni-directional character at both frequency regions of operation.

FIG. 12 shows a particular example of a radiating structure 1200 comprising two radiation boosters 1201 and 1202 located at the short edge of a substantially rectangular ground plane layer 1203. The radiation booster 1201 features a planar structure inspired in a space-filling geometry based on the Hilbert curve while the radiation booster 1202 features a planar structure with a rectangular shape. In other embodiments radiation booster 1202 could present a square shape. Both radiation boosters include conductive parts. The planar nature of the radiation boosters is suitable for integrating the radiating system in a slim wireless handheld or portable device.

The first radiation booster 1201 comprises a connection point 1206. In turn, the ground plane layer 1203 also comprises a first connection point 1207 substantially on the upper left corner of the ground plane layer 1207. A first internal port of the radiating structure 1200 is defined between said connection point 1206 and said first connection point 1207.

Similarly, the second radiation booster 1202 comprises a connection point 1204, and the ground plane layer 1203 also comprises a second connection point 1205 substantially on the upper right corner of the ground plane layer 1203. A second internal port of the radiating structure 1200 is defined between said connection point 1204 and said second connection point 1205.

Each one of said internal ports of the radiating structure 1200 is connected to a port of a radiofrequency system 330*a*, that is the internal port defined by the connection points 1206 and 1207 is connected to the port 332*a* of the radiofrequency system 330*a*. At the same time, the internal port defined by the connection points 1204 and 1205 is connected to the port 333*a* of the radiofrequency system 330*a*.

In other examples, the radiofrequency system 330*b* is used. In these examples, the internal port defined by the connection points 1206 and 1207 is connected to the port 332*b* of the radiofrequency system 330*b*. At the same time, the internal port defined by the connection points 1204 and 1205 is connected to the port 333*b* of the radiofrequency system 330*b*.

The use of said radiation booster 1201 adds a degree of freedom in the design process. In this regard, the use of a radiation booster 1201 enables a lower value of the reactance cancellation element 334*a*. For this particular example the reactance cancellation element 334*a* for the radiation booster 1201 is an inductor. A lower value of a reactance cancellation element is desired in order to obtain a high-Q. A reactance cancellation element presenting a high Q is desirable for decreasing the losses introduced by the radiofrequency system, thus improving the efficiency of the radiating system.

FIG. 13 shows a radiating structure 1300 comprising two radiation boosters 1301 and 1303 located at the corners of a short edge of a rectangular ground plane layer 1303. The radiation booster 1301 features a planar structure inspired in a space-filling geometry based on the Hilbert curve. The radiation booster 1302 includes a conductive part featuring a polyhedral shape comprising six faces.

The use of different topologies of the radiation booster 1301 and 1302 adds more degrees of freedom in the design process. For example, the radiation booster 1302 is advantageously used for the low frequency region while the radiation booster 1301 is advantageously used for the high frequency region.

FIG. 14 shows a radiating structure 1400 comprising two radiation boosters 1401 and 1402 located on a rectangular ground plane layer 1403 having representative dimensions of a tablet device. Some representative dimensions of a tablet device are 240 mm×180 mm, 194 mm×122 mm, 230 mm×158 mm, 257 mm×175 mm, 179 mm×110 mm, 271 mm×171 mm. The radiation boosters 1401 and 1402 include a conductive part featuring a polyhedral shape comprising six faces. Other typologies use ground plane boosters such as for example 1201, 1202, 1701, and 1801.

The radiation boosters 1401 and 1402 include a conductive part featuring a polyhedral shape comprising six faces. The radiation booster 1401 is located at the corner of the ground plane layer 1403 while the radiation booster 1402 is located at a certain distance from the first radiation booster 1401. The distance of the second radiation booster 1402 is fixed by several reasons. The first reason obeys to mechanical constraints given by the device architecture which limits the volume dedicated to the radiating part, whereas the second reason is related to the electromagnetic performance. In this regard, the location of the second radiation booster 1402 is optimized to excite an efficient radiating mode of the ground plane layer 1403 while allowing the interconnection of both radiation boosters through a proper length of the delay element.

Each one of said internal ports of the radiating structure 1400 can be connected to a radiofrequency system according to the present invention as those illustrated in FIG. 3.

In another example, the second radiation booster 1402 is located at an opposite corner of the same edge of the ground plane layer 1403. In this case, the delay element of the radiofrequency system features a length at least equal to the distance between radiation booster 1401 and 1402.

FIG. 15 shows a radiating structure 1500 comprising two radiation boosters 1501 and 1502 located on a ground plane layer 1503 having dimensions and topology representative of a laptop. The radiation booster 1501 and 1502 include a conductive part featuring a polyhedral shape comprising six faces. Although other geometries such as those illustrated in figures above can be used instead.

The ground plane layer 1503 comprises two parts (bottom part 1504 and upper part 1505), which are connected by a conductive element 1506 in the hinge area.

In this particular example, the radiation boosters 1501 and 1502 are located in the upper part 1505 of the ground plane layer 1503 whereas in other preferred examples, they are located in the bottom part 1504 of the ground plane layer.

In a particular example, the radiation boosters 1501 and 1502 are located at the long upper edge of the upper part 1505 of the ground plane layer 1503. In yet other examples, the radiation boosters 1501 and 1502 are located close to the hinge of the ground plane layer 1503. In a further example, a radiation 1501 is located at the long upper edge of the upper part 1505 of the ground plane layer while a second radiation booster 1502 is located at the long upper edge of the bottom part 1504 of the ground plane layer 1503.

FIG. 16 shows a radiating structure 1600 comprising two radiation boosters 1601 and 1602 located on a ground plane layer 1603 representative of a dongle device connected to a laptop. The ground plane layer 1603 is connected to the ground plane 1609 of the laptop by a conductive element 1608.

For this example, the radiation boosters 1601 and 1602 feature a planar shape which is preferred for integrating said radiation boosters in a dongle device.

FIG. 17 shows a radiating structure 1700 comprising two radiation boosters 1701 and 1702 located on a ground planer layer 1703. The first radiation booster 1701 comprises a gap defined in a ground plane 1703 and a second radiation booster comprising a conductive part featuring a polyhedral shape comprising six faces.

The radiation booster 1701 is advantageously located at the middle of the long edge of the ground plane layer 1703. Said location is preferred when an efficient radiation mode featuring a longitudinal current distribution is excited in the ground plane layer 1703. Otherwise, the radiation booster 1702 is advantageously located at a corner of the ground plane layer 1703.

The first radiation booster 1701 comprises a connection point 1706. In turn, the ground plane layer 1703 also comprises a first connection point 1707 substantially on the middle of the long edge of the ground plane layer 1703. A first internal port of the radiating structure 1700 is defined between said connection point 1706 and said first connection point 1707.

Similarly, the second radiation booster 1702 comprises a connection point 1704, and the ground plane layer 1703 also comprises a second connection point 1705 substantially on the upper right corner of the ground plane layer 1703. A second internal port of the radiating structure 1700 is defined between said connection point 1704 and said second connection point 1705.

Each one of said internal ports of the radiating structure 1700 is connected to an internal port of a radiofrequency system 330*a*, that is the internal port defined by the connection points 1706 and 1707 is connected to the port 332*a* of the radiofrequency system 330*a*. At the same time, the internal port defined by the connection points 1704 and 1705 is connected to the port 333*a* of the radiofrequency system 330*a*. For this particular example, the reactance cancellation element 334*a* comprises a capacitor while the reactance cancellation element 335*a* comprises an inductor. In other examples, the radiofrequency system 330*b* is preferred.

FIG. 18 shows a radiating structure 1800 comprising two radiation boosters 1801 and 1802 located on a ground planer layer 1803. The first radiation booster 1801 comprises a gap defined in a ground plane 1803 and a second radiation booster comprising a conductive part featuring a polyhedral shape comprising six faces.

The first radiation booster 1801 features a gap using a space-filling curve based on the Hilbert curve. Shaping said radiation booster 1801 using a space-filling curve is advantageous for some particular cases to reduce the value of the reactance cancellation element. For this particular example, a capacitor is used as a reactance cancellation element. Capacitors with low values are preferred than capacitors featuring high values since low values present generally higher Q and therefore the losses introduced by the radiofrequency system are minimized.

FIG. 19 shows a radiating structure 1900 comprising two radiation boosters 1901 and 1902 located on a rectangular ground plane layer 1903 of dimensions representative of a smartphone. The radiation boosters 1901 and 1902 include a conductive part featuring a polyhedral shape comprising six faces. Other typologies use ground plane boosters such as for example 1201, 1202, 1701, 1801, and 2001.

For this particular example, radiation boosters 1901 and 1902 are located at the two farther corners of the ground plane layer 1903. Said configuration is preferred in some cases in order to efficiently excite a radiation mode of the ground plane layer 1903 in the first frequency region of operation of the radiating system.

FIG. 20 shows a radiating structure 2000 comprising two radiation boosters 2001 and 2002 located on a rectangular ground plane layer 2003 of dimensions representative of a smart phone. The first radiation booster 2001 comprises a conductive part featuring a planar shape 2008 substantially parallel to the ground plane layer 2003 and a vertical strip 2009 substantially normal to the surface of the ground plane layer 2003. The orthogonal projection of the planar shape 2008 lies in the surface of the ground plane layer 2003. The radiation boosters 2002 include a conductive part featuring a polyhedral shape comprising six faces.

The strip 2009 has two ends; one end is connected to the planar shape 2008 while the other end is connected to the connection point 2006. In turn, the ground plane layer 2003 also comprises a first connection point 2007 substantially on the upper left corner of the ground plane layer 2007. A first internal port of the radiating structure 2000 is defined between said connection point 2006 and said first connection point 2007.

Similarly, the second radiation booster 2002 comprises a connection point 2004, and the ground plane layer 2003 also comprises a second connection point 2005 substantially on the upper right corner of the ground plane layer 2003. A second internal port of the radiating structure 2000 is defined between said connection point 2004 and said second connection point 2005.

Each one of said internal ports of the radiating structure 2000 is connected to a port of a radiofrequency system 330*a*, that is the internal port defined by the connection points 2006 and 2007 is connected to the port 332*a* of the radiofrequency system 330*a*. At the same time, the internal port defined by the connection points 2004 and 2005 is connected to the port 333*a* of the radiofrequency system 330*a*.

FIG. 21 shows a radiating structure 2100 comprising four radiation boosters 2101, 2102, 2103, and 2104 located on a rectangular ground plane layer 2105 of dimensions representative of a smartphone. The radiation boosters 2101, 2102, 2013, and 2104 include a conductive part featuring a polyhedral shape comprising six faces.

This particular example is based on FIG. 4 having a replica of the first and second radiation boosters 401 and 402 at the other edge of the ground plane layer.

The first radiation booster 2101 comprises a connection point 2106. In turn, the ground plane layer 2105 also comprises a first connection point 2107 substantially on the upper left corner of the ground plane layer 2105. A first internal port of the radiating structure 2100 is defined between said connection point 2106 and said first connection point 2107.

Similarly, the second radiation booster 2102 comprises a connection point 2108, and the ground plane layer 2105 also comprises a second connection point 2109 substantially on the upper right corner of the ground plane layer 2105. A second internal port of the radiating structure 2100 is defined between said connection point 2108 and said second connection point 2109.

Each one of said internal ports of the radiating structure 2100 is connected to a port of a radiofrequency system 330*a*, that is the internal port defined by the connection points 2106 and 2107 is connected to the port 332*a* of the radiofrequency system 330*a*. At the same time, the internal port defined by the connection points 2108 and 2109 is connected to the port 333*a* of the radiofrequency system 330*a*.

In the same example, a third radiation booster 2103 comprises a connection point 2112. In turn, the ground plane layer 2105 also comprises a first connection point 2113 substantially on the lower left corner of the ground plane layer 2105. A first internal port of the radiating structure 2100 is defined between said connection point 2112 and said first connection point 2113.

Similarly, the forth radiation booster 2104 comprises a connection point 2110, and the ground plane layer 2105 also comprises a second connection point 2111 substantially on the lower right corner of the ground plane layer 2105. A second internal port of the radiating structure 2100 is defined between said connection point 2110 and said second connection point 2111.

Each one of said internal ports of the radiating structure 2100 is connected to a port of a radiofrequency system 330*a*, that is the internal port defined by the connection points 2112 and 2112 is connected to the port 332*a* of the radiofrequency system 330*a*. At the same time, the internal port defined by the connection points 2110 and 2111 is connected to the port 333*a* of the radiofrequency system 330*a*.

For this particular example, the first radiation booster 2101 and the second radiation booster 2102 connected to a radiofrequency system 330*a* such as the one shown in FIG. 5 provide operation as shown in FIG. 7 in a first frequency region of the electromagnetic spectrum between 824 MHz and 960 MHz and in a second frequency region of the electromagnetic spectrum between 1710 MHz and 2690 MHz. At the same time, the third radiation booster 2103 and the forth 2104 connected to a different radiofrequency system 330*a* provide also operation in the same said frequency bands. This configuration provides a radiating system robust to human loading effects and in particular to the finger effect.

In yet another example, the first radiation booster 2101 and the second radiation booster 2102 connected to a radiofrequency system 330*a* such as the one shown in FIG. 5 provide operation as shown in Figure suitable for operating in a first frequency region of the electromagnetic spectrum between 824 MHz and 960 MHz and in a second frequency region of the electromagnetic spectrum between 1710 MHz and 2690 MHz. At the same time the third radiation booster 2103 and the forth 2104 connected to a different radiofrequency system 330*a* provide operation in two frequency regions different than the ones provided by the radiating system having the first radiation booster 2102 and the second radiation booster 2102.

The radiating structure of FIG. 4 and the radiofrequency system of FIG. 5 could be advantageously provided on a common layer of a PCB, as it is shown in FIG. 22, in which a ground plane layer 2210 and the conducting traces and pads of the radiofrequency system that make it possible to interconnect a first and a second radiation booster to an external port 2211 are provided on a layer of a PCB 2212, which is connected to an integrated circuit chip 2212 performing radiofrequency functionality.

The first radiation booster 401 in FIG. 4 could be mounted on a first area 2201 of the PCB 2212 (delimited with a dash-dotted line) and the connection point 403 of the first radiation booster 401 be electrically connected (e.g., soldered) to a mounting pad 2203. Analogously, the second radiation booster 402 could be provided on a second area 2202 (also delimited with a dash-dotted line on the PCB 2212), and the connection point 405 of said second radiation booster 402 be electrically connected to a mounting pad 2204.

The reactance cancellation element 2205 for the radiation booster 401 is connected to one end of the delay element 2207 while the reactance cancellation element 2206 for the radiation booster 402 is connected to the delay 2007 at the other end. In this example, the reactance cancellation element 535 is equivalent to the reactance cancellation element 2205, the reactance cancellation element 534 is equivalent to the reactance cancellation element 2206, and the delay element 536 is equivalent to the delay element 2207. Finally, the fine tuning stage 537 is equivalent to the series reactance element 2208 and the shunt reactance element 2209. The external port 531 of the radiating system is equivalent to the external port 2211 which is connected to an integrated circuit chip 2212 performing radiofrequency functionality.

The conducting trace 2207 together with the ground plane layer 2210 defines a coplanar transmission line. In an example, said transmission line (the delay element) features a characteristic impedance of 50 Ohms. In another example, the conducting trace 2207 is designed to obtain a different characteristic impedance to optimize the impedance bandwidth. The length of the delay element 2207 is also adjusted to optimize the impedance bandwidth.

A radiating system for a wireless device typically includes a radiating structure comprising an antenna element which operates in combination with a ground plane layer providing a determined radioelectric performance in one or more frequency regions of the electromagnetic spectrum. This is illustrated in FIG. 23, in which it is shown a conventional radiating structure 2300 comprising an antenna element 2301 and a ground plane layer 2302. Typically, the antenna element has a dimension close to an integer multiple of a quarter of the wavelength at a frequency of operation of the radiating structure, so that the antenna element is at resonance at said frequency and a radiation mode is excited on said antenna element.

Although the radiating structure is usually very efficient at the resonance frequency of the antenna element and maintains a similar performance within a frequency range defined around said resonance frequency (or resonance frequencies), outside said frequency range the efficiency and other relevant antenna parameters deteriorate with an increasing distance to said resonance frequency.

Furthermore, the radiating structure operating at a resonance frequency of the antenna element is typically very sensitive to external effects (such as for instance the presence of plastic or dielectric covers that surround the wireless device), to components of the wireless device (such as for instance, but not limited to, a speaker, a microphone, a connector, a display, a shield can, a vibrating module, a battery, or an electronic module or subsystem) placed either in the vicinity of, or even underneath, the antenna element, and/or to the presence of the user of the wireless device.

Any of the above mentioned aspects may alter the current distribution and/or the electromagnetic field distribution of a radiation mode of the antenna element, which usually translates into detuning effects, degradation of the radioelectric performance of the radiating structure and/or the radioelectric performance wireless device, and/or greater interaction with the user (such as an increased level of SAR).

FIG. 24 shows an example of a radiating structure for a radiating system, the radiating structure including a first 2401 and a second 2401 radiation booster, each one comprising a conductive part integrated in a headset device 2404 comprising a ground plane layer 2403.

FIG. 25 shows and example of a delay element comprising a transmission line 2501, two series inductors 2502 and 2503 and two shunt capacitors 2504 and 2505. In an example, this configuration substitutes the delay element 536 in FIG. 5 in order to obtain a more compact solution. The compact solution is achieved by the reactive elements 2502, 2503, 2504, and 2505. That is, the total length of the transmission line 2501 is shorter than the transmission line 536 due to the addition of the said reactive elements 2502, 2503, 2504, and 2505. Furthermore, the addition of said reactive elements not only provides miniaturization but add also a degree of freedom to design the characteristic impedance of the delay element. In this regard, the square root of the ratio of the inductance L of the inductor 2502 over the capacitance of the capacitor 2504 determines the equivalent characteristic impedance 1. In turn, the square root of the ratio of the inductance L of the inductor 2503 over the capacitance of the capacitor 2505 determines the equivalent characteristic impedance 2. The values of the characteristic impedance of the transmission line 2501, the equivalent characteristic impedance for the stage 2502-2504, and for the stage 2503-2505 are optimized in order to enhance the impedance bandwidth of the radiating system.

In yet another example, the delay element comprises a transmission line 2501 and only one stage 2502 and 2504. In a further example, the delay element comprises a transmission line and more than two stages 2502 and 2504. In yet another example, the delay element comprises several transmission lines cascaded with stages 2502 and 2504. In yet another example, the reactive components can be further optimized so as the delay element comprises a transmission line, a series inductor 2502 and 2503 and a shunt capacitor 2504. In yet another example, the stage comprises a series capacitor and a shunt inductor. All these examples add flexibility to optimize the delay element for impedance bandwidth enhancement.

What is claimed is:

1. An apparatus comprising:

a radiating system configured to transmit and receive electromagnetic wave signals in first and second frequency regions, wherein a highest frequency of the first frequency region is lower than a lowest frequency of the second frequency region, the radiating system comprising:

a radiating structure comprising: a first radiation booster having a maximum size smaller than 1/30 times the free-space wavelength of the lowest frequency of the first frequency region; a second radiation booster having a maximum size smaller than 1/30 times the free-space wavelength of the lowest frequency of the first frequency region; a ground plane layer; a first internal port defined between a connection point of the first radiation booster and one connection point of the ground plane layer; and a second internal port defined between a connection point of the second radiation booster and one connection point of the ground plane layer;

an external port; and a radiofrequency system comprising:

a first port connected to the first internal port of the radiating structure; a second port connected to the second internal port of the radiating structure; a third port connected to the external port of the radiating system;

a first reactance cancellation element having a first end connected to the first port and a second end connected to the third port, the first reactance cancellation element being configured to provide an impedance having an imaginary part substantially close to zero for a frequency allocated in the first frequency region;

a second reactance cancellation element having a first end connected to the second port and a second end connected to the third port, the second reactance cancellation element being configured to provide an impedance having an imaginary part substantially close to zero for a frequency allocated in the second frequency region; and a delay element interconnecting the second ends of the first and second reactance cancellation elements and being connected between the second end of one of the first and second reactance cancellation elements and the third port, the delay element introducing at the third port a difference in phase between an input impedance associated with the first internal port and an input impedance associated with the second internal port such that signals from the first and second radiation boosters are combined at the third port with a relative delay and the first and second input impedances are combined at the third port to provide an impedance bandwidth that covers the first and second frequency regions, wherein the difference in phase introduced by the delay element is between 40° and 150° at the lowest frequency of the first frequency region;

wherein the radiofrequency system is configured to provide operation in at least one frequency band in the first frequency region and in at least one frequency band in the second frequency region at the external port.

2. The apparatus of claim 1, wherein the delay element comprises at least one of a transmission line, lumped elements, an active circuit component, or a combination thereof.

3. The apparatus of claim 1, wherein the radiating system is configured to operate in at least five frequency bands associated with cellular communication standards.

4. The apparatus of claim 1, wherein the difference in phase introduced by the delay element is substantially close to 90° at the lowest frequency of the first frequency region.

5. The apparatus of claim 1, wherein the radiofrequency system further comprises a fine tuning stage connected between the third port of the radiofrequency system and the external port of the radiating system.

6. The apparatus of claim 5, wherein the fine tuning stage comprises at least one active circuit component.

7. The apparatus of claim 1, wherein the delay element comprises a transmission line having a characteristic impedance different than 50 ohms.

8. The apparatus of claim 1, wherein the delay element comprises a transmission line featuring a characteristic impedance substantially equal to 50 ohms and a length of approximately a quarter of a wavelength at the lowest frequency of the first frequency region.

9. The apparatus of claim 1, wherein the difference in phase introduced by the delay element is substantially close to 90° at the center frequency of the first frequency region.

10. The apparatus of claim 1, wherein each of the first and second radiation boosters features a polyhedral shape comprising six faces.

11. The apparatus of claim 1, wherein the first radiation booster and the second radiation booster protrude beyond the ground plane layer.

12. An apparatus comprising:

a radiating system configured to transmit and receive electromagnetic wave signals in first and second frequency regions, wherein a highest frequency of the first frequency region is lower than a lowest frequency of the second frequency region, the radiating system comprising:

an external port;

a radiating structure comprising:

a first radiating element configured to provide a resonant frequency allocated in the first frequency region and having a maximum size smaller than 1/10 times the free-space wavelength of the lowest frequency of the first frequency region;

a second radiating element configured to provide a resonant frequency allocated in the second frequency region and having a maximum size smaller than 1/10 times the free-space wavelength of the lowest frequency of the first frequency region;

a ground plane layer;

a first internal port defined between a connection point of the first radiating element and one connection point of the ground plane layer; and a second internal port defined between a connection point of the second radiating element and one connection point of the ground plane layer; and a radiofrequency system comprising: a first port connected to the first internal port of the radiating structure; a second port connected to the second internal port of the radiating structure; a third port connected to the external port of the radiating system, the first and second ports being connected to the third port; and a delay element interconnecting the first and second ports and being connected between one of the first and second ports and the third port, the delay element introducing at the third port a difference in phase between an input impedance associated with the first internal port and an input impedance associated with the second internal port such that signals from the first and second radiation boosters are combined at the third port with a relative delay and the first and second input impedances are combined at the third port to provide an impedance bandwidth that covers the first and second frequency regions, wherein the difference in phase introduced by the delay element is between 40° and 150° at the lowest frequency of the first frequency region;

wherein the radiofrequency system is configured to provide operation in at least one frequency band in the first frequency region and in at least one frequency band in the second frequency region at the external port.

13. The apparatus of claim 12, wherein the delay element comprises a transmission line featuring a length of approximately a quarter of a wavelength at the lowest frequency of the first frequency region.

14. The apparatus of claim 12, wherein the difference in phase introduced by the delay element is substantially close to 90° at the lowest frequency of the first frequency region.

15. The apparatus of claim 12, wherein the radiofrequency system further comprises a fine tuning stage connected between the third port of the radiofrequency system and the external port of the radiating system.

16. The apparatus of claim 12, wherein the difference in phase introduced by the delay element is larger than 40° at the lowest frequency of the first frequency region.

17. The apparatus of claim 12, wherein the first radiating element is formed by a single radiating arm.

18. The apparatus of claim 17, wherein the second radiating element is formed by a single radiating arm.

19. The apparatus of claim 18, wherein the first radiating element and the second radiating element protrude beyond the ground plane layer.

* * * * *